US008235106B2

(12) United States Patent
Fox et al.

(10) Patent No.: US 8,235,106 B2
(45) Date of Patent: Aug. 7, 2012

(54) FORMATION TESTING AND SAMPLING APPARATUS AND METHODS

(75) Inventors: Philip Edmund Fox, Covington, LA (US); Michael E. Shade, Spring, TX (US); Gregory N Gilbert, Sugar Land, TX (US); Mark A. Proett, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/688,991

(22) Filed: Jan. 18, 2010

(65) Prior Publication Data

US 2010/0116494 A1 May 13, 2010

Related U.S. Application Data

(63) Continuation of application No. 11/590,027, filed on Oct. 30, 2006, now Pat. No. 7,650,937, which is a continuation of application No. 10/384,470, filed on Mar. 7, 2003, now Pat. No. 7,128,144.

(51) Int. Cl.
*E21B 49/10* (2006.01)

(52) U.S. Cl. ..... 166/100; 166/264; 73/152.25; 73/152.26

(58) Field of Classification Search ..... 166/100, 166/264; 73/152.23, 152.24, 152.25, 152.26
See application file for complete search history.

(56) References Cited

U.S. PATENT DOCUMENTS

| | | | |
|---|---|---|---|
| 2,262,655 | A | 11/1941 | Seale |
| 2,581,070 | A | 1/1952 | Blood |
| 2,747,401 | A | 5/1956 | Doll |
| 2,892,501 | A | 6/1959 | Boller |
| 3,011,554 | A | 12/1961 | Desbrandes et al. |
| 3,181,608 | A | 5/1965 | Palmer |
| 3,209,588 | A | 10/1965 | Terry |
| 3,212,574 | A | 10/1965 | Fox |
| 3,254,531 | A | 6/1966 | Briggs, Jr. |
| 3,289,474 | A | 12/1966 | Smith |

(Continued)

FOREIGN PATENT DOCUMENTS

| | | |
|---|---|---|
| EP | 0530105 | 8/1992 |

(Continued)

OTHER PUBLICATIONS

Supplementary Partial European Search Report completed Apr. 5, 2006 (with Appendix B and Annex to the European Search Report) for European Application No. 04718003.9-2315.

(Continued)

*Primary Examiner* — Shane Bomar
*Assistant Examiner* — Robert E Fuller
(74) *Attorney, Agent, or Firm* — Jones Day

(57) ABSTRACT

Systems and methods for downhole formation testing based on the use of one or more elongated sealing pads capable of sealing off and collecting or injecting fluids from elongated portions along the surface of a borehole. The modified sealing pads increase the flow area by collecting fluids from an extended portion along the surface of a borehole, which is likely to straddle one or more layers in laminated or fractured formations. A tester device using the elongated sealing pads can be deployed and withdrawn using an extendible element pressing the pads to the borehole. Various designs and arrangements for use with a fluid tester, which may be part of a modular fluid tool, are disclosed in accordance with different embodiments.

15 Claims, 21 Drawing Sheets

U.S. PATENT DOCUMENTS

| | | | |
|---|---|---|---|
| 3,396,796 | A | 8/1968 | Voetter |
| 3,452,592 | A | 7/1969 | Voetter |
| 3,530,933 | A | 9/1970 | Whitten |
| 3,577,782 | A | 5/1971 | Aitken |
| 3,577,783 | A | 5/1971 | Whitten et al. |
| 3,611,799 | A | 10/1971 | Davis |
| 3,653,436 | A | 4/1972 | Anderson et al. |
| 3,677,080 | A | 7/1972 | Hallmark |
| 3,864,970 | A | 2/1975 | Bell |
| 3,952,588 | A | 4/1976 | Whitten |
| 4,210,018 | A | 7/1980 | Brieger |
| 4,292,842 | A | 10/1981 | Hallmark |
| 4,339,948 | A | 7/1982 | Hallmark |
| 4,416,152 | A | 11/1983 | Wilson |
| 4,470,456 | A | 9/1984 | Moutray, III |
| 4,483,189 | A | 11/1984 | Seal |
| 4,513,612 | A | 4/1985 | Shalek |
| 4,593,560 | A | 6/1986 | Purfurst |
| 4,676,096 | A | 6/1987 | Bardsley et al. |
| 4,720,996 | A | 1/1988 | Marsden et al. |
| 4,745,802 | A | 5/1988 | Purfurst |
| 4,845,982 | A | 7/1989 | Gilbert |
| 4,860,581 | A | 8/1989 | Zimmerman et al. |
| 4,879,900 | A | 11/1989 | Gilbert |
| 4,936,139 | A | 6/1990 | Zimmerman et al. |
| 4,951,749 | A | 8/1990 | Carroll |
| 4,962,665 | A | 10/1990 | Savage et al. |
| 5,056,595 | A | 10/1991 | Desbrandes |
| 5,138,877 | A | 8/1992 | Desbrandes |
| 5,230,244 | A | 7/1993 | Gilbert |
| 5,233,866 | A | 8/1993 | Desbrandes |
| 5,265,015 | A | 11/1993 | Auzerais et al. |
| 5,279,153 | A | 1/1994 | Dussan et al. |
| 5,293,931 | A | 3/1994 | Nichols et al. |
| 5,335,542 | A | 8/1994 | Ramakrishnan et al. |
| 5,353,637 | A | 10/1994 | Plumb et al. |
| 5,549,159 | A | 8/1996 | Shwe et al. |
| 5,672,819 | A | 9/1997 | Chin et al. |
| 5,741,962 | A | 4/1998 | Birchak et al. |
| 5,796,252 | A | 8/1998 | Kleinberg et al. |
| 5,826,662 | A | 10/1998 | Beck et al. |
| 5,934,374 | A | 8/1999 | Hrametz et al. |
| 6,157,893 | A | 12/2000 | Berger et al. |
| 6,173,793 | B1 | 1/2001 | Thompson et al. |
| 6,230,557 | B1 | 5/2001 | Ciglenec et al. |
| 6,301,959 | B1 | 10/2001 | Hrametz et al. |
| 6,585,045 | B2 | 7/2003 | Lee et al. |
| 6,729,399 | B2 | 5/2004 | Follini et al. |
| 6,986,282 | B2 | 1/2006 | Ciglenec et al. |
| 7,121,338 | B2 | 10/2006 | van Zuilekom et al. |
| 7,128,144 | B2 | 10/2006 | Fox et al. |
| 7,416,023 | B2 | 8/2008 | Krueger et al. |
| 8,015,867 | B2 * | 9/2011 | Kerr et al. ..... 73/152.26 |
| 2005/0268709 | A1 * | 12/2005 | McGregor et al. ..... 73/152.27 |
| 2007/0039731 | A1 | 2/2007 | Fox et al. |
| 2008/0156487 | A1 | 7/2008 | Zazovsky et al. |
| 2010/0132940 | A1 | 6/2010 | Proett et al. |

FOREIGN PATENT DOCUMENTS

| | | |
|---|---|---|
| EP | 0689722 | 1/1996 |
| GB | 1209948 | 10/1970 |
| GB | 2348222 | 3/2000 |
| WO | WO 01/042617 | 6/2001 |
| WO | WO 02/08571 | 1/2002 |

OTHER PUBLICATIONS

Supplementary European Search Report completed Oct. 17, 2006 (with Appendix B and Annex to the European Search Report) for European Application No. 04718003.9-2315.

International Search Report mailed Jan. 24, 2005 for International Application No. PCT/US2004/06784.

International Preliminary Report on Patentability issued Sep. 9, 2005 for International Application No. PCT/US2004/06784.

European Search Report for Application No. 03791853.9-1234, dated Oct. 8, 2009.

EPO Communication in European Application No. 04 718 003.9 dated Jul. 28, 2010.

European Office Action of application No. 02776580.9-1240, dated Dec. 15, 2009.

Supplemental Partial European Search Report of EP application No. 10183081.8-2315, dated Dec. 29, 2010.

European Search Report of EP application No. 10183081.8-2315, dated Mar. 11, 2011.

* cited by examiner

Pumping, SL=39", PL=48", Flow rate 26.8986053 cc/sec

Pumping, SL=39", PL=48", Flow rate 2.1127117 cc/sec

FORMATION TESTING AND SAMPLING APPARATUS AND METHODS

I. CROSS-REFERENCE TO RELATED APPLICATIONS

This patent application is a continuation of, and incorporates by reference herein, U.S. patent application Ser. No. 11/590,027 filed Oct. 30, 2006, now U.S. Pat. No. 7,650,937, which is a continuation of U.S. patent application Ser. No. 10/384,470 filed Mar. 7, 2003, now U.S. Pat. No. 7,128,144.

II. FIELD OF THE INVENTION

The present invention pertains generally to investigations of underground formations and more particularly to systems and methods for formation testing and fluid sampling within a borehole.

III. BACKGROUND OF THE INVENTION

The oil and gas industry typically conducts comprehensive evaluation of underground hydrocarbon reservoirs prior to their development. Formation evaluation procedures generally involve collection of formation fluid samples for analysis of their hydrocarbon content, estimation of the formation permeability and directional uniformity, determination of the formation fluid pressure, and many others. Measurements of such parameters of the geological formation are typically performed using many devices including downhole formation testing tools.

Recent formation testing tools generally comprise an elongated tubular body divided into several modules serving predetermined functions. A typical tool may have a hydraulic power module that converts electrical into hydraulic power; a telemetry module that provides electrical and data communication between the modules and an uphole control unit; one or more probe modules collecting samples of the formation fluids; a flow control module regulating the flow of formation and other fluids in and out of the tool; and a sample collection module that may contain various size chambers for storage of the collected fluid samples. The various modules of a tool can be arranged differently depending on the specific testing application, and may further include special testing modules, such as NMR measurement equipment. In certain applications the tool may be attached to a drill bit for logging-while-drilling (LWD) or measurement-while drilling (MWD) purposes. Examples of such multifunctional modular formation testing tools are described in U.S. Pat. Nos. 5,934,374; 5,826,662; 5,741,962; 4,936,139, and 4,860,581, the contents of which are hereby incorporated by reference for all purposes.

In a typical operation, formation-testing tools operate as follows. Initially, the tool is lowered on a wireline into the borehole to a desired depth and the probes for taking samples of the formation fluids are extended into a sealing contact with the borehole wall. Formation fluid is then drawn into the tool through inlets, and the tool can perform various tests of the formation properties, as known in the art.

Prior art wireline formation testers typically rely on probe-type devices to create a hydraulic seal with the formation in order to measure pressure and take formation samples. Typically, these devices use a toroidal rubber cup-seal, which is pressed against the side of the wellbore while a probe is extended from the tester in order to extract wellbore fluid and affect a drawdown. This is illustrated schematically in FIG. 1, which shows typical components of an underground formation tester device, such as a probe with an inlet providing fluid communication to the interior of the device, fluid lines, various valves and a pump for regulating the fluid flow rates. In particular, FIG. 1 shows that the rubber seal of the probe is typically about 3-5" in diameter, while the probe itself is only about 0.5" to 1" in diameter. In various testing applications prior art tools may use more than one probe, but the contact with the formation remains at a small point area.

The reliability and accuracy of measurements, made using the tool illustrated in FIG. 1, depends on a number of factors. In particular, the producibility of a hydrocarbon reservoir is known to be controlled by variations in reservoir rock permeability due to matrix heterogeneities. It is also well known that underground formations are often characterized by different types of porosity and pore size distribution, which may result in wide permeability variations over a relatively small cross-sectional area of the formation. For example, laminated or turbidite formations, which are common in sedimentary environments and deep offshore reservoirs, are characterized by multiple layers of different formations (e.g., sand, shale, hydrocarbon). These layers may or may not be aligned diagonally to the longitudinal axis of a vertical borehole and exhibit differing permeabilities and porosity distributions. Similarly, as shown in FIG. 2, in naturally fractured formations whose physical properties have been deformed or altered during their deposition and in vugular formations 53 having erratic pore size and distribution, permeabilities to oil and gas may vary greatly due to the matrix 55 heterogeneities.

For example, in laminated or turbidite reservoirs, a significant volume of oil in a highly permeable stratum, which may be as thin as a few centimeters, can be trapped between two adjacent formation layers, which may have very low permeabilities. Thus, a formation testing tool, which has two probes located several inches apart along the longitudinal axis of the tool with fluid inlets being only a couple of centimeters in diameter, may easily miss such a rich hydrocarbon deposit. For the same reasons, in a naturally fractured formation, in which oil or gas is trapped in the fracture, the fracture, such as fracture 57 shown in FIG. 2, acts as a conduit allowing formation fluids to flow more freely to the borehole and causing the volume of hydrocarbon to be underestimated. On the other hand, in a vugular formation a probe may encounter an oil vug and predict high volume of hydrocarbon, but due to the lack of connectivity between vugs such high estimate of the reservoir's producibility will be erroneous.

One solution to the above limitations widely used in prior art wireline formation testers is to deploy straddle packers. Straddle packers are inflatable devices typically mounted on the outer periphery of the tool and can be placed as far as several meters apart from each other. FIG. 3 illustrates a prior art device using straddle packers (cross-hatched areas) in a typical configuration. The packers can be expanded in position by inflating them with fluid through controlled valves. When expanded, the packers isolate a section of the borehole and samples of the formation fluid from the isolated area can be drawn through one or more inlets located between the packers. These inflatable packers are used for open hole testing and have historically been deployed on drill pipe. Once the sample is taken, the straddle packers are deflated and the device can be moved to a new testing position. A number of formation tester tools, including the Modular Formation Dynamics Tester (MDT) by Schlumberger, use straddle packers in a normal operation.

Although the use of straddle packers may significantly improve the flow rate over single or dual-probe assemblies because fluid is being collected from the entire isolated area, it also has several important limitations that adversely affect its application in certain reservoir conditions. For example, it is generally a practice in the oil and gas industry to drill boreholes large enough to accommodate different types of testing, logging, and pumping equipment; therefore, a typical size of a borehole can be as much as 50 cm in diameter. Since the diameter of a typical formation-testing tool ranges from 10 cm to 15 cm and an inflated packer can increase this range approximately by an additional 10 cm, the packers may not provide sufficient isolation of the sampled zone. As a result, sufficient pressure may not be established in the zone of interest to draw fluids from the formation, and drilling mud circulating in the borehole may also be pumped into the tool.

Furthermore, while straddle packers are effective in many applications, they present operational difficulties that cannot be ignored. These include a limitation on the number of pressure tests before the straddle packers deteriorate, temperature limitations, differential pressure limitations (drawdown versus hydrostatic), and others. Another potential drawback of straddle packers includes a limited expansion ratio (i.e., out-of-round or ovalized holes).

A very important limitation of testing using straddle packers is that the testing time is invariably increased due to the need to inflate and deflate the packers. Other limitations that can be readily recognized by those of skill in the art include increased pressure stabilization—large wellbore storage factor, difficulty in testing a zone just above or just below a washout (i.e., packers would not seal); hole size limitations of the type discussed above, and others. Notably, straddle packers are also susceptible to gas permeation and/or rubber vulcanizing in the presence of certain gases.

Accordingly, there is a need to provide a downhole formation testing system that combines both the pressure-testing capabilities of dual probe assemblies and the large exposure volume of straddle packers, without the attending deficiencies associated with the prior art. To this end, it is desirable to provide a system suitable for testing, retrieval and sampling from relatively large sections of a formation along the surface of a wellbore, thereby improving, inter alia, permeability estimates in formations having heterogeneous matrices such as laminated, vugular and fractured reservoirs. Additionally, it is desired that the tool be suitable for use in any typical size boreholes, and be deployable quickly for fast measurement cycles.

IV. SUMMARY OF THE INVENTION

In accordance with the present invention, deficiencies associated with the prior art are overcome using a novel approach, which is to increase the flow area of a pad-type device by using elongated sealing pads, capable of sealing off and collecting fluids from elongated portions along the surface of a borehole. Unlike prior art straddle packers, the sealing pads of a device made in accordance with the present invention can be deployed and withdrawn quickly for fast measurement cycles. It will be appreciated that in operation the sealing pads of this invention may seal off an elongated portion of the borehole that is likely to straddle one or more layers of a laminated or fractured formation, providing more accurate test measurement results compared with prior art toroidal cup seals. Various pad designs and arrangements for use with a fluid tester or a modular fluid tool are disclosed in accordance with different embodiments of the invention.

In particular, in one aspect the invention is a formation tester for sampling formation fluids in a borehole, comprising: at least one inlet providing communication between formation fluids and the interior of the tester; an elongated sealing pad attached to at least one inlet; the sealing pad having an outer surface for hydraulically sealing an elongated region along a surface of the borehole; and a mechanism controlling drawdown of formation fluids through the inlet into the tester, wherein formation fluids are being drawn from the elongated region along the surface of the borehole sealed off by the sealing pad. In various specific embodiments the tester may further comprise an extendible element for engaging the outer surface of the sealing pad with the surface of the borehole, where the extendible element provides fluid communication between the inlet(s) and the interior of the tester. Preferably, the sealing pad is made of elastomeric material and has one or more recesses that extend longitudinally along the outer surface of the pad, establishing a fluid flow channel along the surface of the borehole sealed off by the sealing pad. Generally, the sealing pad of the tester is dimensioned to straddle at least two layers of a laminated or naturally fractured formation in a borehole, depending on the encountered geological setting and, in a preferred embodiment, is at least 20 cm long.

In another aspect, the invention is a tool for testing or retrieval of fluids from an underground formation, comprising one or more inlets providing fluid communication between the formation fluids and the tool; sealing means for providing hydraulically sealed contact along an elongated region on the surface of a borehole and for collecting formation fluids inside the elongated sealed off region through the one or more inlets; and a means for controlling, varying and pulsing the rate of retrieval or injection of formation or other fluids through the one or more inlets into the tool or from an inlet fluid reservoir.

In yet another aspect, the invention is a method of testing a reservoir formation comprising the steps of lowering a formation tester into a borehole; the tester having at least one inlet and an elongated sealing pad attached to at least one inlet, the sealing pad having an outer surface for hydraulically sealing an elongated portion along a surface of the borehole; at least one inlet and the sealing pad being attached to an extendable element; positioning the extendable element adjacent a selected subterranean formation; extending the extendable element to establish a sealing engagement with the surface of the borehole; the sealing pad of the tester isolating an elongated portion of the borehole adjacent the selected formation; and drawing into the tester formation fluids from the isolated portion of the well bore. In more specific embodiments, the method further comprises the step regulating the drawdown of formation fluids into the tester using a control device, and sensing at least one characteristic of the formation fluids drawn into the tester.

In one important aspect, devices and methods in accordance with the present invention may be used in both wireline and measurement-while-drilling (MWD) and logging-while-drilling (LWD) operations.

Examples and other important features of the present invention thus have been summarized in order that detailed description thereof that follows may be better understood, and that the contributions to the art may be appreciated.

V. BRIEF DESCRIPTION OF THE DRAWINGS

These and other aspects of the invention are more fully explained in the following detailed description of the preferred embodiments, and are illustrated in the drawings, in which.

Figure 8A:
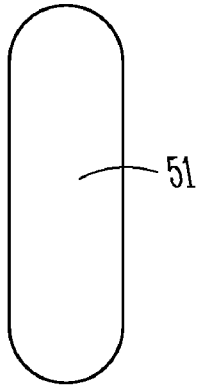
Figure 8B:
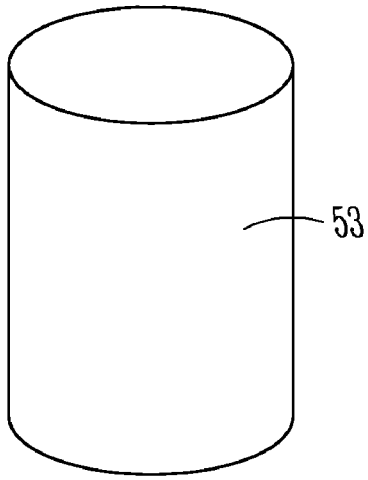
Figure 9:
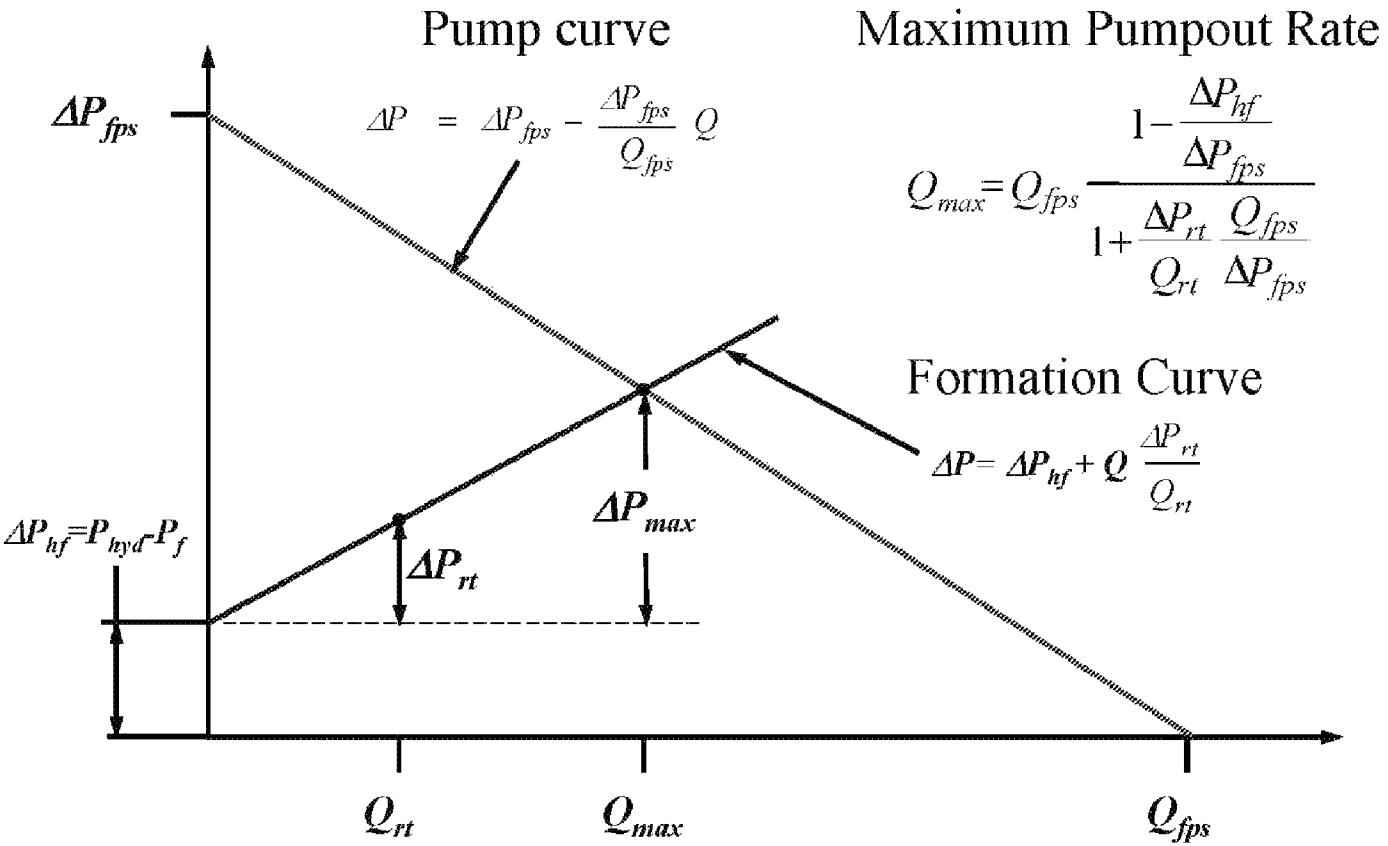
Figure 10:
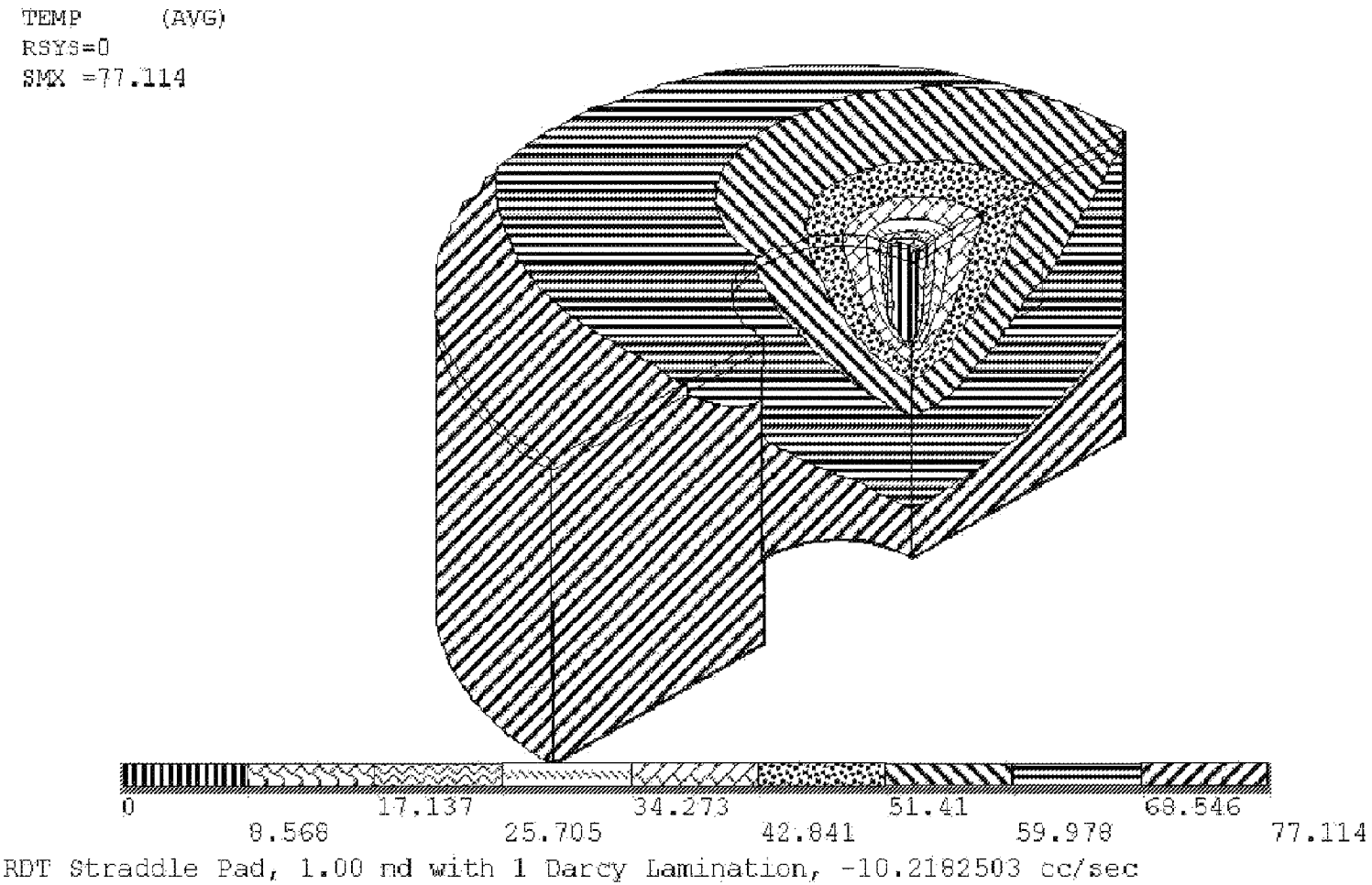
Figure 11:
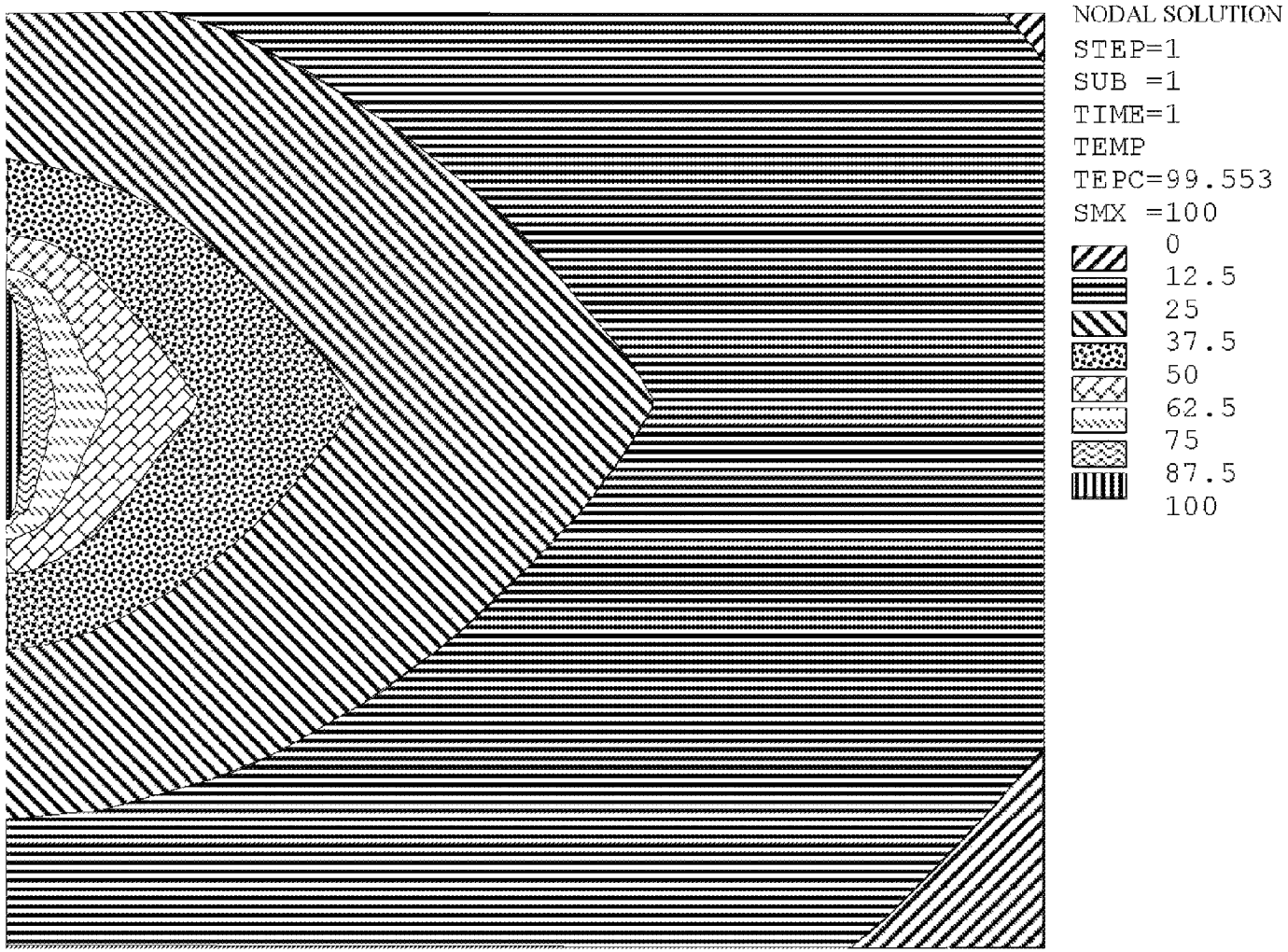
Figure 12:
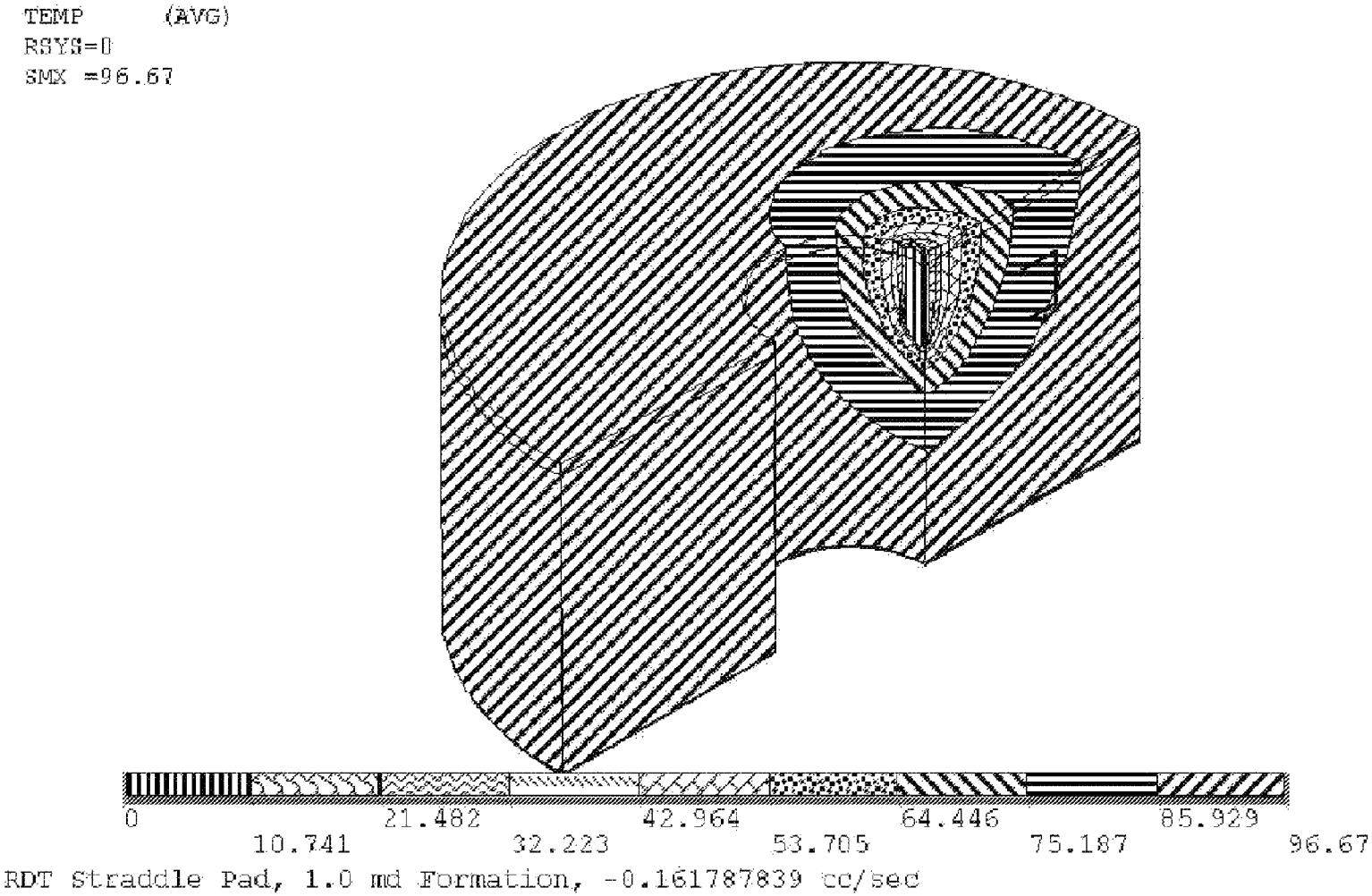
Figure 13:
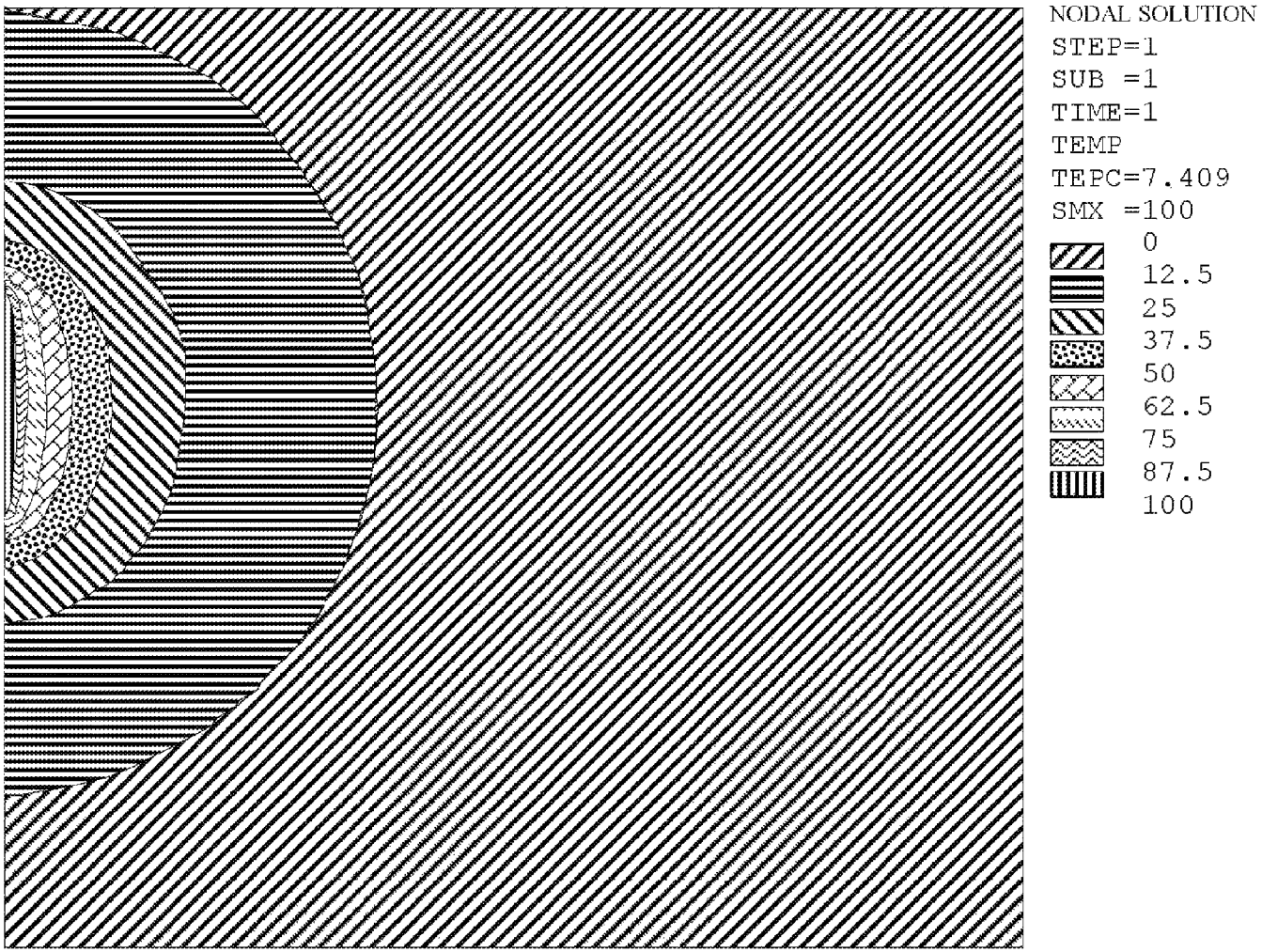

FIGS. 6A-B, 6C-D and 6E-F are schematic diagrams of probe modules according to alternative embodiments of the present invention;

FIGS. 7A-F are CAD models and schematics of a sealing pad in accordance with this invention; FIGS. 7G-H show additional detail about how the screen and gravel pack probe works in a preferred embodiment of the present invention;

FIGS. 8A and 8B show a graphical comparison of an Oval Pad design used in accordance with the present invention with a prior art Inflatable Packers flow area;

FIG. 9 illustrates the determination of the maximum pump-out rate in the comparison tests between the Oval Pad design prior art Inflatable Packers design;

FIG. 10 is a pressure contour plot of an Oval Pad in accordance with this invention, in a ¼ cross section. This finite element simulation shows how the Oval Pad pressures are distributed in the formation at 10.2 cc/sec producing a 100 psi pressure drop from formation pressure. The formation has a 1" lamination located at the center of the pad;

FIG. 11 is a pressure contour plot of a straddle packer using an axisymmetric finite element simulation; a 100 psi pressure drop between the straddle packers creates a 26.9 cc/sec flow rate; the formation has a 1" lamination centered between the straddle packers;

FIG. 12 is a contour plot similar to the one shown in FIG. 10, but a 1 mdarcy homogeneous formation is simulated for the Oval Pad. In this case, a 100 psi pressure drop causes the Oval Pad to flow at 0.16 cc/sec;

FIG. 13 is similar to FIG. 11 but a 1 mdarcy homogeneous formation is simulated for the Inflatable Packers design.

Figure 14:
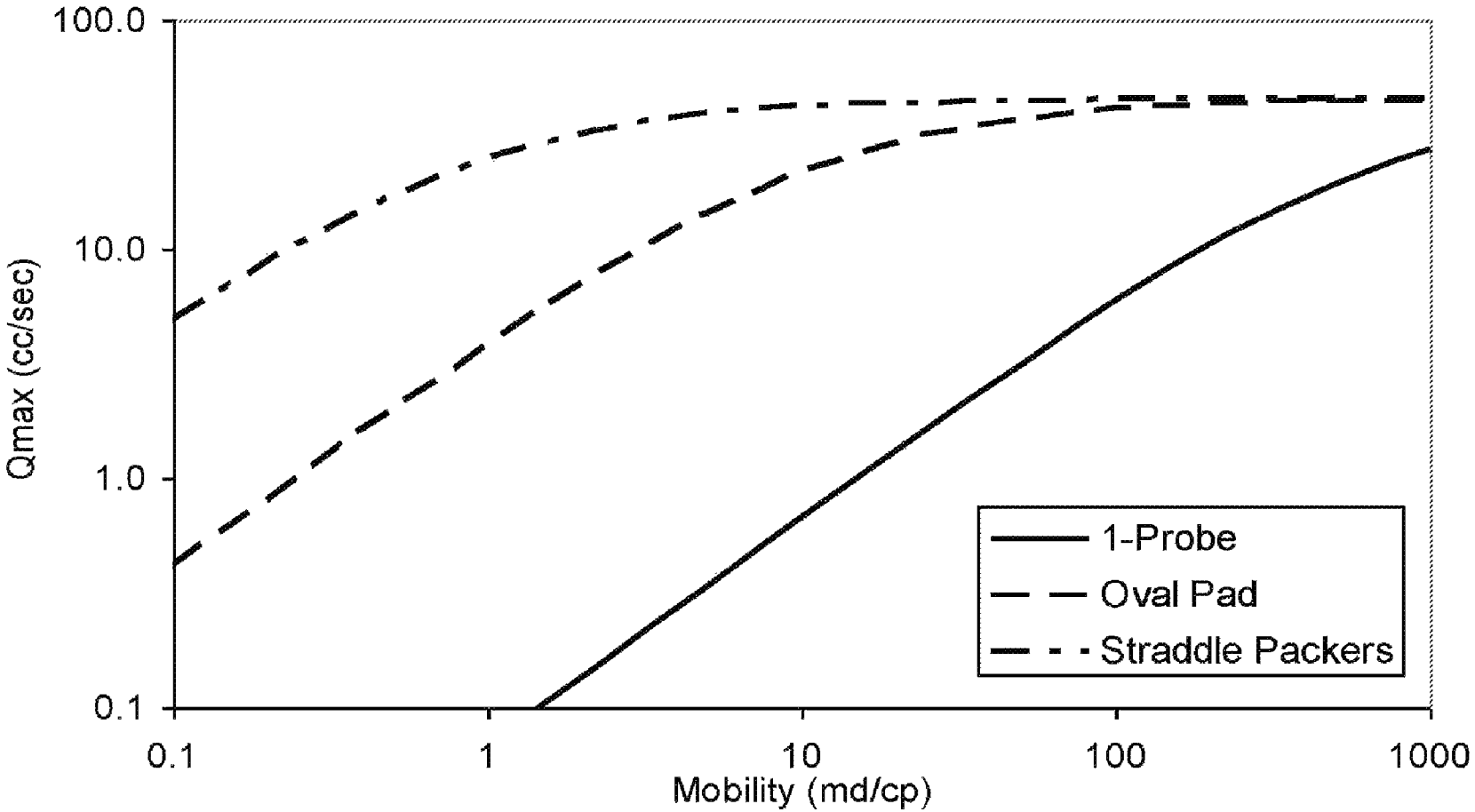
Figure 15:
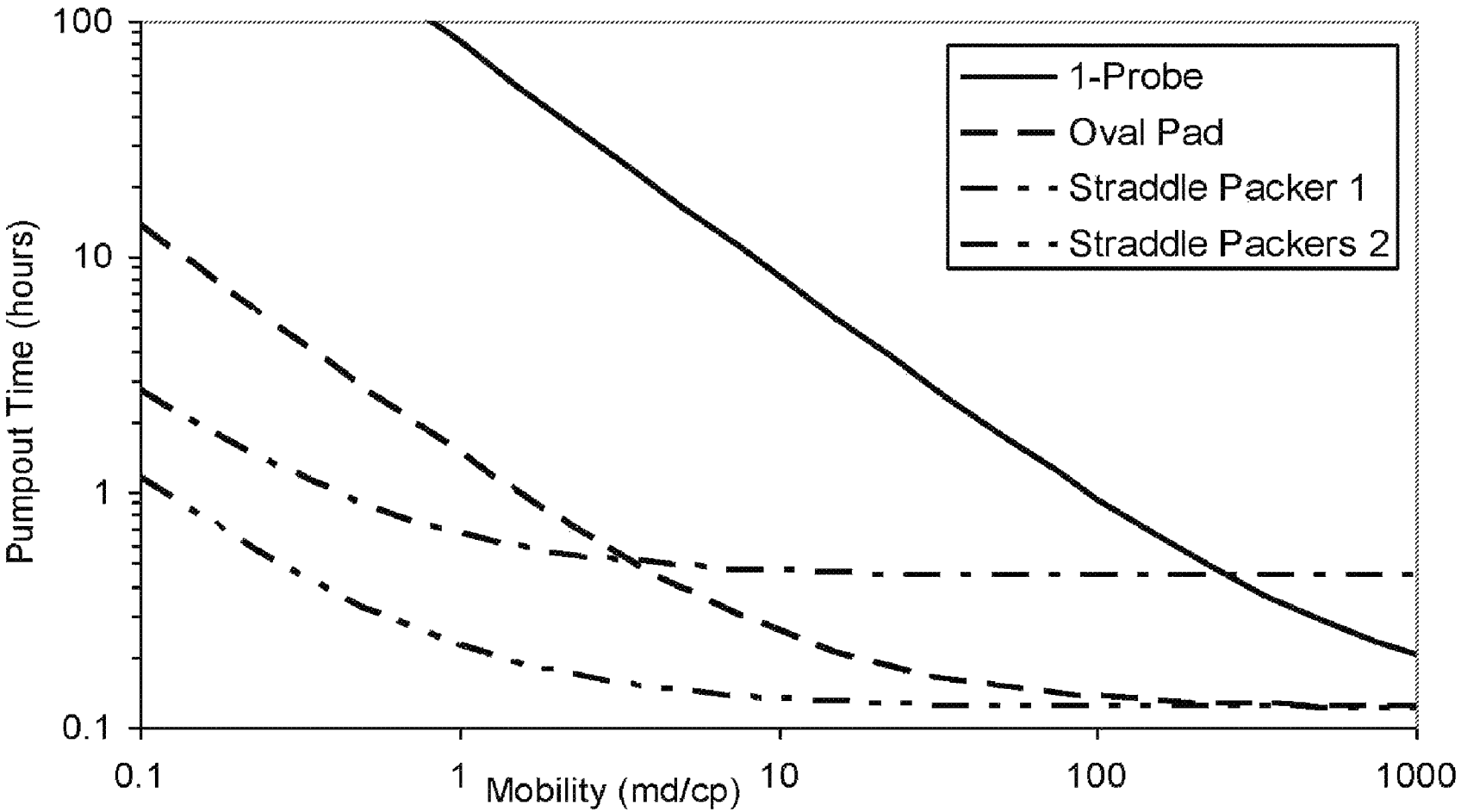

FIGS. 14 and 15 show the pumping performance (flow rate) differences between the Oval Pad and Inflatable Packers technologies. The advantage of using the Oval Pad design in low permeability zones is that a controllable pumping rate can be maintained where a probe device requires a flow rate that is too low to be measured accurately.

Figure 16:
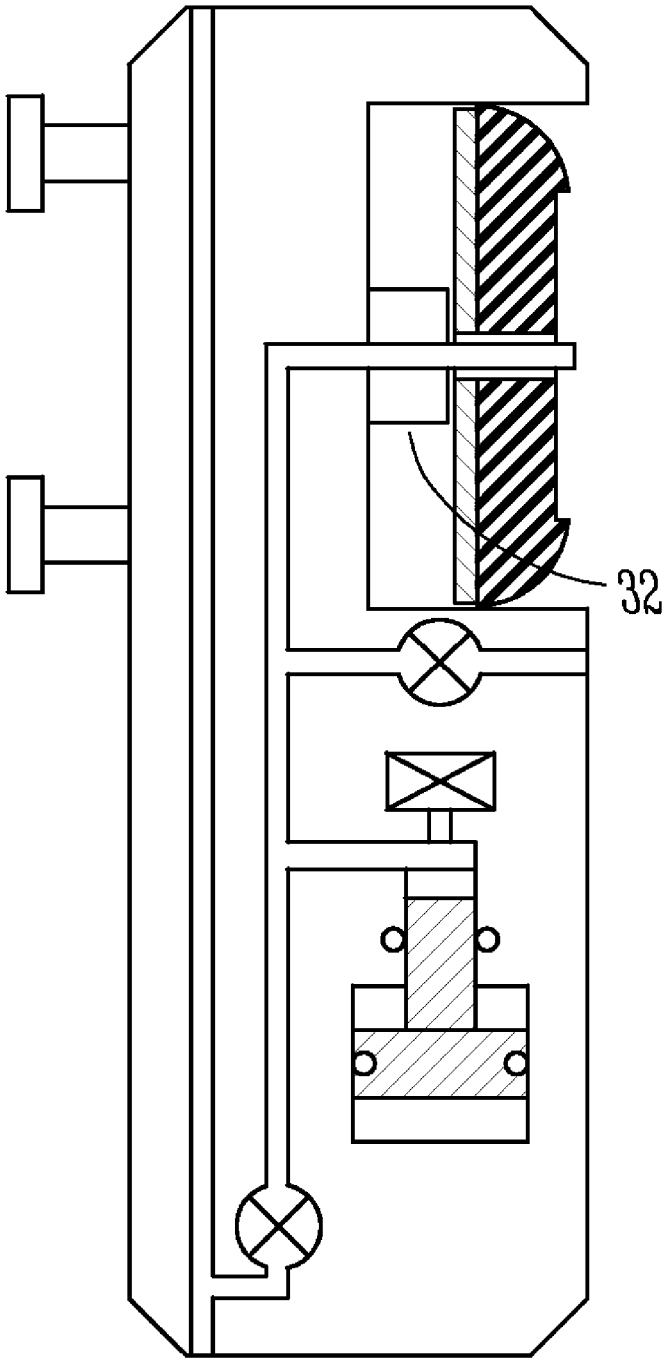

FIG. 16 shows an elongated sealing pad being retracted without extending beyond the periphery of the tester.

VI. DETAILED DESCRIPTION OF THE INVENTION

The Modular Fluid Testing Tool

Figure 4:
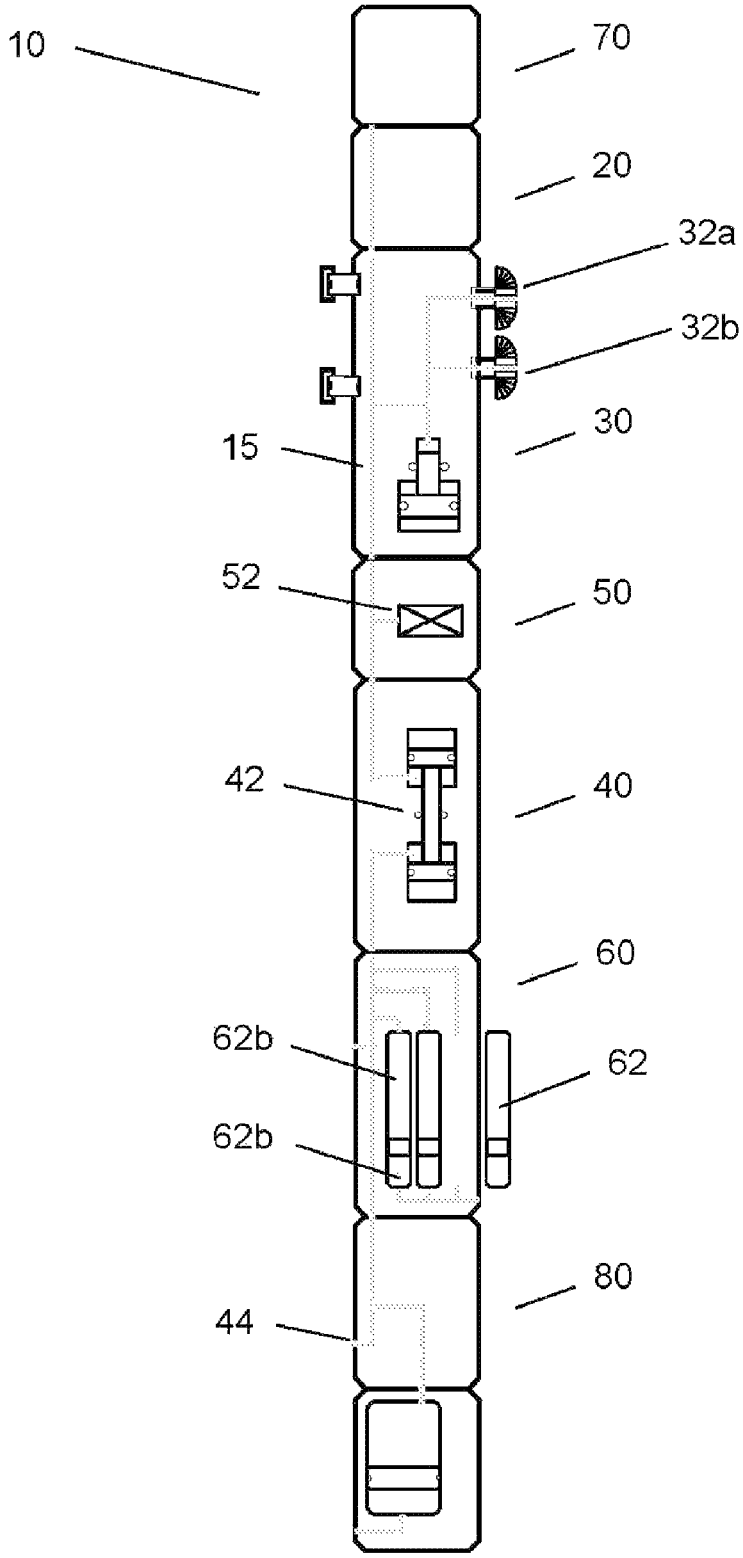
FIG. 4 shows a schematic diagram of a modular downhole formation-testing tool, which can be used in accordance with a preferred embodiment in combination with the elongated pad design of the present invention.

The system of present invention is best suited for use with a modular downhole formation testing tool, which in a preferred embodiment is the Reservoir Description Tool (RDT) by Halliburton. As modified in accordance with the present invention, the tool is made suitable for testing, retrieval and sampling along sections of the formation by means of contact with the surface of a borehole. In accordance with a preferred embodiment illustrated in FIG. 4, the formation-testing tool 10 comprises several modules (sections) capable of performing various functions. As shown in FIG. 4, tool 10 may include a hydraulic power module 20 that converts electrical into hydraulic power; a probe module 30 to take samples of the formation fluids; a flow control module 40 regulating the flow of various fluids in and out of the tool; a fluid test module 50 for performing different tests on a fluid sample; a multi-chamber sample collection module 60 that may contain various size chambers for storage of the collected fluid samples; a telemetry module 70 that provides electrical and data communication between the modules and an uphole control unit (not shown), and possibly other sections designated in FIG. 4 collectively as 80. The arrangement of the various modules may depend on the specific application and is not considered herein.

More specifically, the power telemetry section 70 conditions power for the remaining tool sections. Each section preferably has its own process-control system and can function independently. While section 70 provides a common intra-tool power bus, the entire tool string (extensions beyond tool 10 not shown) shares a common communication bus that is compatible with other logging tools. This arrangement enables the tool in a preferred embodiment to be combined with other logging systems, such as a Magnetic Resonance Image Logging (MRIL†) or High-Resolution Array Induction (HRAI†) logging systems.

Formation-testing tool 10 is conveyed in the borehole by wireline (not shown), which contains conductors for carrying power to the various components of the tool and conductors or cables (coaxial or fiber optic cables) for providing two-way data communication between tool 10 and an uphole control unit. The control unit preferably comprises a computer and associated memory for storing programs and data. The control unit generally controls the operation of tool 10 and processes data received from it during operations. The control unit may have a variety of associated peripherals, such as a recorder for recording data, a display for displaying desired information, printers and others. The use of the control unit, display and recorder are known in the art of well logging and are, thus, not discussed further. In a specific embodiment, telemetry module 70 may provide both electrical and data communication between the modules and the uphole control unit. In particular, telemetry module 70 provides high-speed data bus from the control unit to the modules to download sensor readings and upload control instructions initiating or ending various test cycles and adjusting different parameters, such as the rates at which various pumps are operating.

Flow control module 40 of the tool preferably comprises a double acting piston pump, which controls the formation fluid flow from the formation into flow line 15 via probes 32*a* and 32*b*. The pump operation is generally monitored by the uphole control unit. Fluid entering the probes 32*a* and 32*b* flows through the flow line 15 and may be discharged into the wellbore via outlet 44. A fluid control device, such as a control valve, may be connected to flow line 15 for controlling the fluid flow from the flow line 15 into the borehole. Flow line fluids can be preferably pumped either up or down with all of the flow line fluid directed into or though pump 42. Flow control module 40 may further accommodate strain-gauge pressure transducers that measure an inlet and outlet pump pressures.

The fluid testing section 50 of the tool contains a fluid testing device, which analyzes the fluid flowing through flow line 15. For the purpose of this invention, any suitable device or devices may be utilized to analyze the fluid. For example, Halliburton Memory Recorder quartz gauge carrier can be used. In this quartz gauge the pressure resonator, temperature compensation and reference crystal are packaged as a single unit with each adjacent crystal in direct contact. The assembly is contained in an oil bath that is hydraulically coupled with the pressure being measured. The quartz gauge enables measurement of such parameters as the drawdown pressure of fluid being withdrawn and fluid temperature. Moreover, if two fluid testing devices 52 are run in tandem, the pressure difference between them can be used to determine fluid viscosity during pumping or density when flow is stopped.

Sample collection module 60 of the tool may contain various size chambers for storage of the collected fluid sample. Chamber section 60 preferably contains at least one collection chamber, preferably having a piston that divides chamber 62 into a top chamber 62*a* and a bottom chamber 62*b*. A conduit is coupled to bottom chamber 62*b* to provide fluid communication between bottom chamber 62*b* and the outside environment such as the wellbore. A fluid flow control device, such as an electrically controlled valve, can be placed in the conduit to selectively open it to allow fluid communication between the bottom chamber 62*b* and the wellbore. Similarly, chamber section 62 may also contain a fluid flow control device, such as an electrically operated control valve, which is selectively opened and closed to direct the formation fluid from the flow line 15 into the upper chamber 62*a*.

The Probe Section

Probe module 30, and more particularly the sealing pad, which is the focus of this invention, comprises electrical and mechanical components that facilitate testing, sampling and retrieval of fluids from the formation. As known in the art, the sealing pad is the part of the tool or instrument in contact with the formation or formation specimen. In accordance with this invention a probe is provided with at least one elongated sealing pad providing sealing contact with a surface of the borehole at a desired location. Through one or more slits, fluid flow channel or recesses in the sealing pad, fluids from the sealed-off part of the formation surface may be collected within the tester through the fluid path of the probe. As discussed in the next section, the recess(es) in the pad is also elongated, preferably along the axis of the elongated pad, and generally is applied along the axis of the borehole. In a preferred embodiment, module 30 is illustrated in FIGS. 5A and 5B.

In the illustrated embodiment, one or more setting rams (shown as 31*a* and 31*b*) are located opposite probes 32*a* and 32*b* of the tool. Rams 31*a* and 31*b* are laterally movable by actuators placed inside the probe module 30 to extend away from the tool. Pretest pump 33 preferably is used to perform pretests on small volumes of formation fluid. Probes 32*a* and 32*b* may have high-resolution temperature compensated strain gauge pressure transducers (not shown) that can be isolated with shut-in valves to monitor the probe pressure independently. Pretest piston pump 33 also has a high-resolution, strain-gauge pressure transducer that can be isolated from the intra-tool flow line 15 and probes 32*a* and 32*b*. Finally, in a preferred embodiment the module may include a resistance, optical or other type of cell (not shown) located near probes 32*a* and 32*b* to monitor fluid properties immediately after entering either probe.

Probe module 30 generally allows retrieval and sampling of formation fluids in sections of a formation along the longitudinal axis of the borehole. As shown in FIG. 5A, module 30 comprises two or more probes (illustrated as 32*a* and 32*b*) preferably located in a range of 5 cm to 100 cm apart. Each probe has a fluid inlet approximately 1 cm to 5 cm in diameter, although other sizes may be used as well in different applications. The probes in a preferred embodiment are laterally movable by actuators placed inside module 30 to extend the probes away from the tool.

Figure 5B:
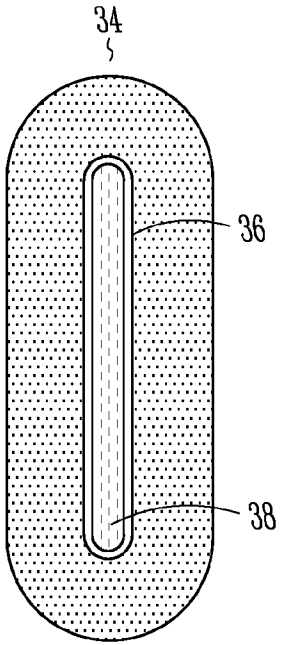
FIGS. 5A and 5B show a schematic diagram of a dual-probe tester module according to a preferred embodiment of the present invention (FIG. 5A) and a cross-section of the elongated sealing pad (FIG. 5B) in one embodiment.
Figure 5A:
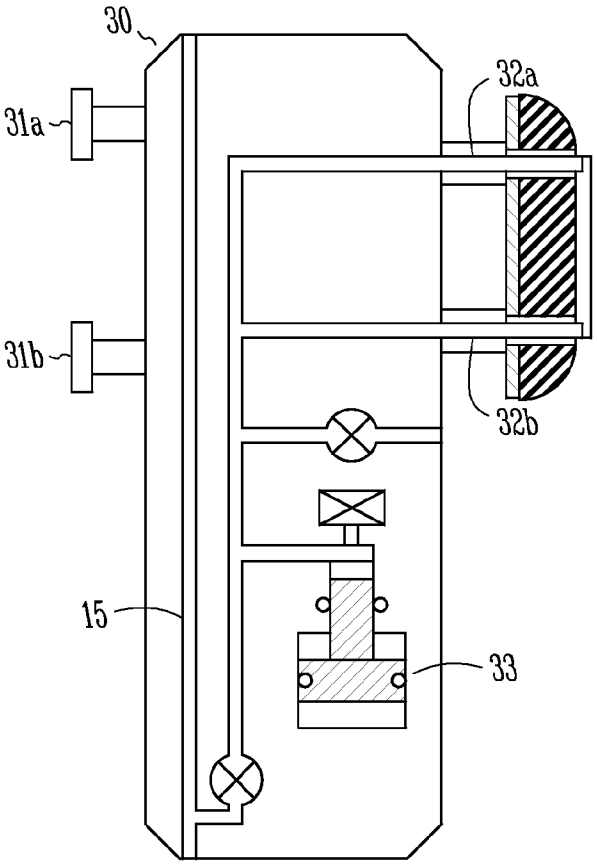

As shown in FIG. 5A and illustrated in further detail in FIG. 5B, attached to the probes in a preferred embodiment is an elongated sealing pad 34 for sealing off a portion on the side wall of a borehole. Pad 34 is removably attached in a preferred embodiment for easy replacement, and is discussed in more detail below. The recess of the sealing pad shown in FIG. 5B measures 9.00" in length and 1.75" in width.

Figure 6B:
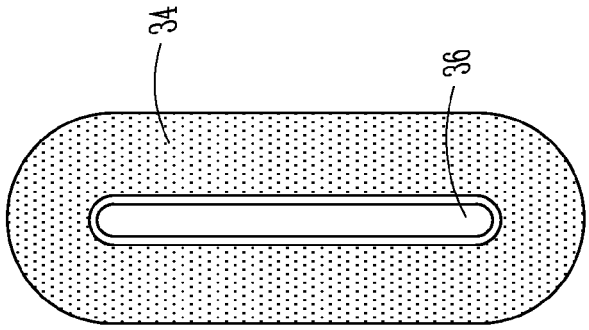
Figure 6A:
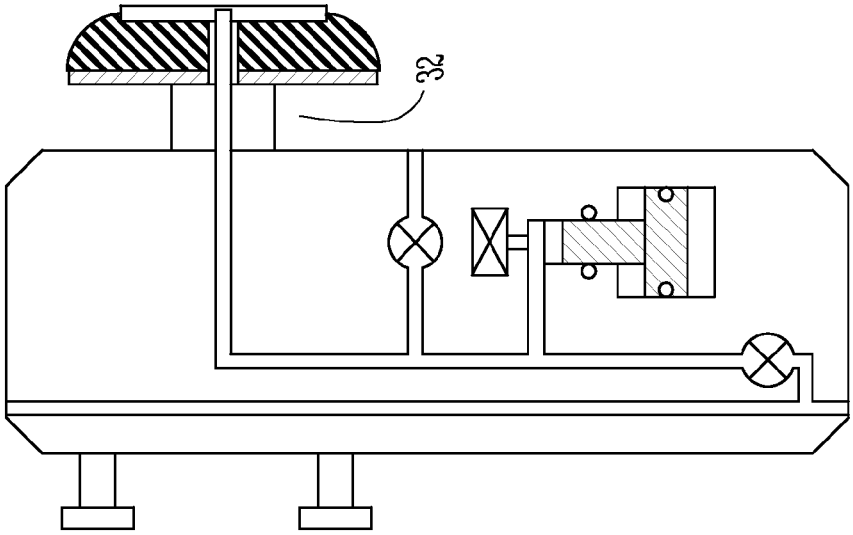
Figure 6D:
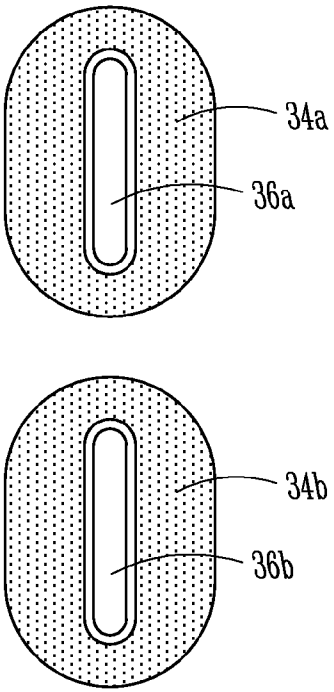
Figure 6C:
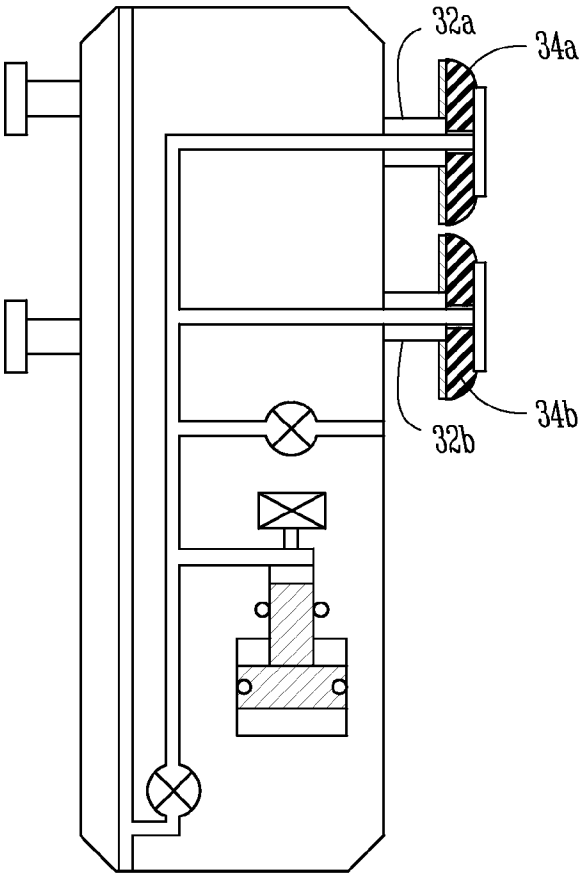
Figure 6F:
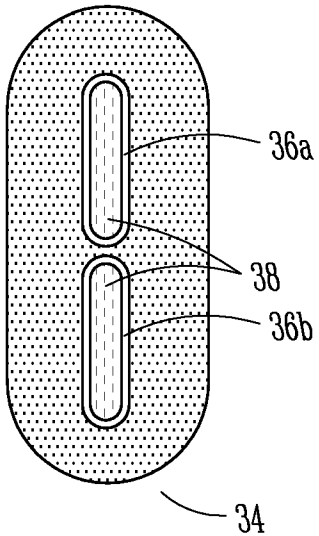
Figure 6E:
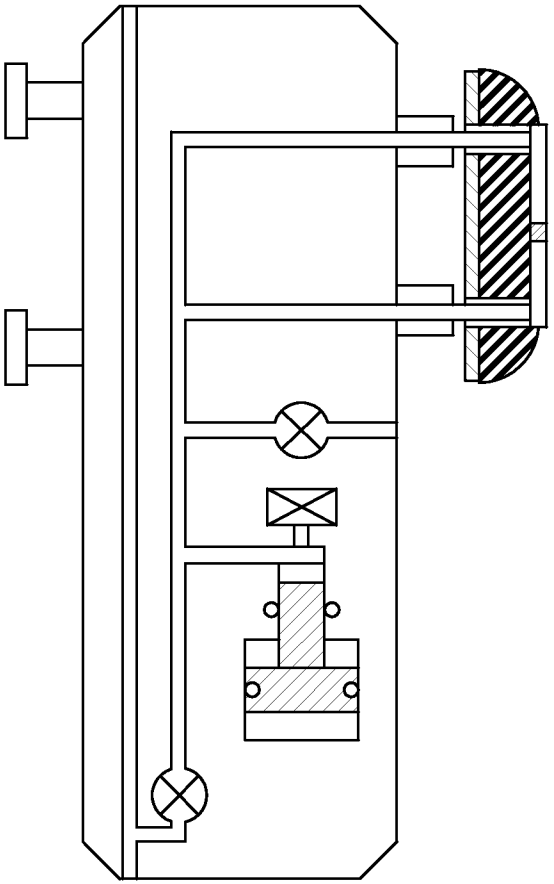

FIGS. 6A-B, 6C-D and 6E-F are schematic diagrams of probe modules according to alternative embodiments of the present invention. In the first alternative design shown in FIG. 6A, a large sealing pad 34 (shown in FIG. 6B) is supported by a single hydraulic piston 32. The second alternative design (shown in FIG. 6C) shows two elongated (FIG. 6D) sealing pads supported by a set of pistons 32*a* and 32*b*. A design using two elongated pads on the same tool may have the advantage of providing a greater longitudinal length that could be covered with two pads versus one. It will be apparent that other configurations may be used in alternate embodiments. FIG. 6F illustrates an embodiment in which the recess in the pad is divided into two parts 36*a* and 36*a* corresponding respectively to fluid flow into the individual probes, as shown in FIG. 6E.

In particular, one such embodiment, which is not illustrated in the figures, is to use an elongated sealing pad attached to multiple hydraulic rams. The idea is to use the rams not only to deploy the pad but also to create separate flow paths. Carrying this idea a bit further, an articulated elongated pad could be supported by several hydraulic rams, the extension of which can be adjusted to cover a greater length of borehole. A potential benefit of articulating the pad is to make it more likely to conform to borehole irregularities, and to provide improved sealing contact.

Another alternative embodiment is to use pads attached to hydraulic rams that are not aligned longitudinally, as shown in FIGS. 5A, 6A, 6C, and 6E. In such embodiments, an array of elongated pads with different angular deployment with respect to the borehole may be used (i.e., diagonally opposite, or placed at various angles with respect to the probe). An expected benefit of an array of pads is that more borehole coverage could be achieved making the device practically equivalent, or in some instances even superior to the straddle packer. In particular, the pads may be arranged in an overlapping spiral fashion around the tool making the coverage continuous.

In alternative embodiments, better design flexibility can be provided using redundancy schemes, in which variable size or property pads, attached to different numbers of extension elements of a probe, and using combinations of different screens, filtering packs, and others may be used.

Alternative designs are clearly possible and are believed to be used interchangeably with the specific designs illustrated in this disclosure.

The Sealing Pad

An important aspect of the present invention is the use of one or more elongated sealing pads with a slot or recess cut into the face of the pad(s), as shown in a preferred embodiment in FIG. 5A. The slot in the pad is preferably screened and gravel or sand packed, depending on formation properties. In operation, sealing pad 34 is used to hydraulically seal off an elongated portion along a surface of the borehole, typically disposed along the axis of the borehole.

FIG. 5A illustrates the face of an elongated sealing pad in accordance with one embodiment of this invention. In this embodiment, sealing pad 34 is preferably at least twice as long as the distance between probes 32*a* and 32*b* and, in a specific embodiment, may be dimensioned to fit, when not in use, into a recess provided on the body of probe module 30 without extending beyond the periphery of the tool. As explained above, sealing pad 34 provides a large exposure area to the formation for testing and sampling of formation fluids across laminations, fractures and vugs.

Sealing pad 34 is preferably made of elastomeric material, such as rubber, compatible with the well fluids and the physical and chemical conditions expected to be encountered in an underground formation. Materials of this type are known in the art and are commonly used in standard cup-shaped seals.

With reference to FIG. 5B, sealing pad 34 has a slit or recess 36 cut therein to allow for drawing of formation fluids into the probes. Slit 36 preferably extends longitudinally the length of sealing pad 34 ending a few centimeters before its edges. The width of slit 36 is preferably greater than, or equal to, the diameter of the inlets. The depth of slit 36 is preferably no greater than the depth of sealing pad 34. In a preferred embodiment, sealing pad 34 further comprises a slotted screen 38 covering slit 36 to filter migrating solid particles such as sand and drilling debris from entering the tool. Screen 38 is preferably configured to filter out particles as small as a few millimeters in diameter. In a preferred embodiment, sealing pad 34 is further gravel or sand packed, depending on formation properties, to ensure sufficient sealing contact with the borehole wall.

Figure 7A:
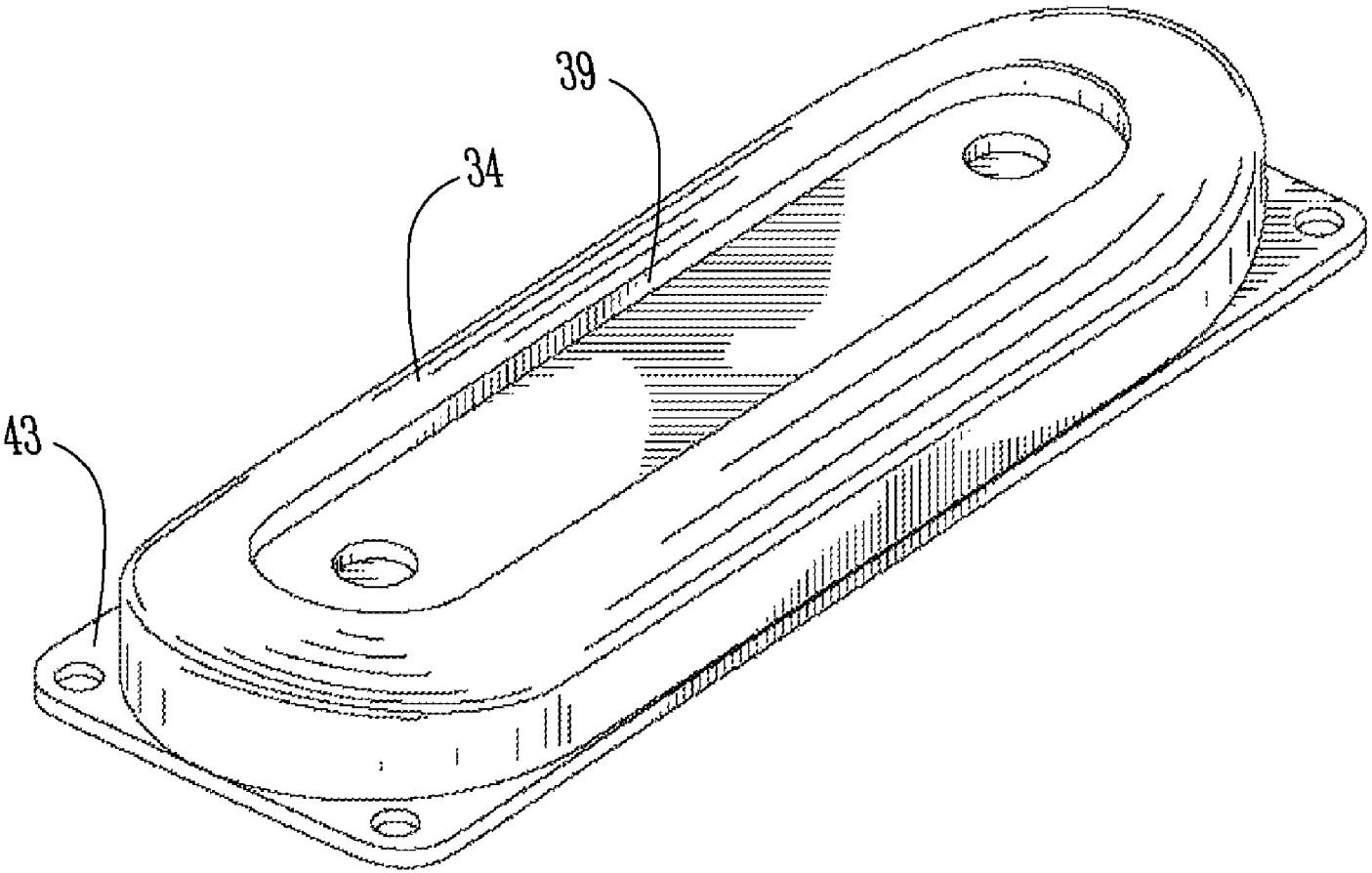
Figure 7E:
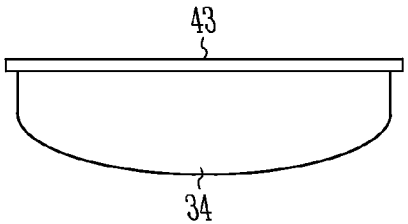
Figure 7B:
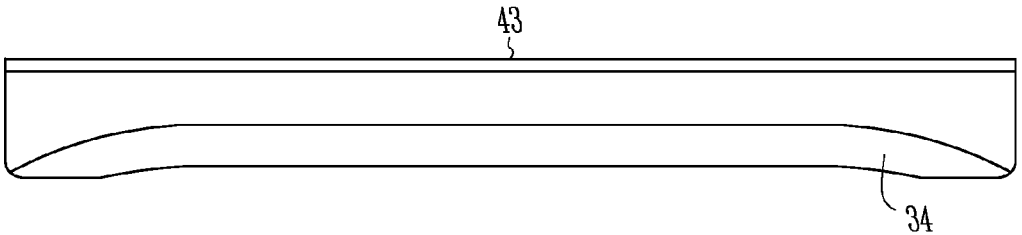
Figure 7C:
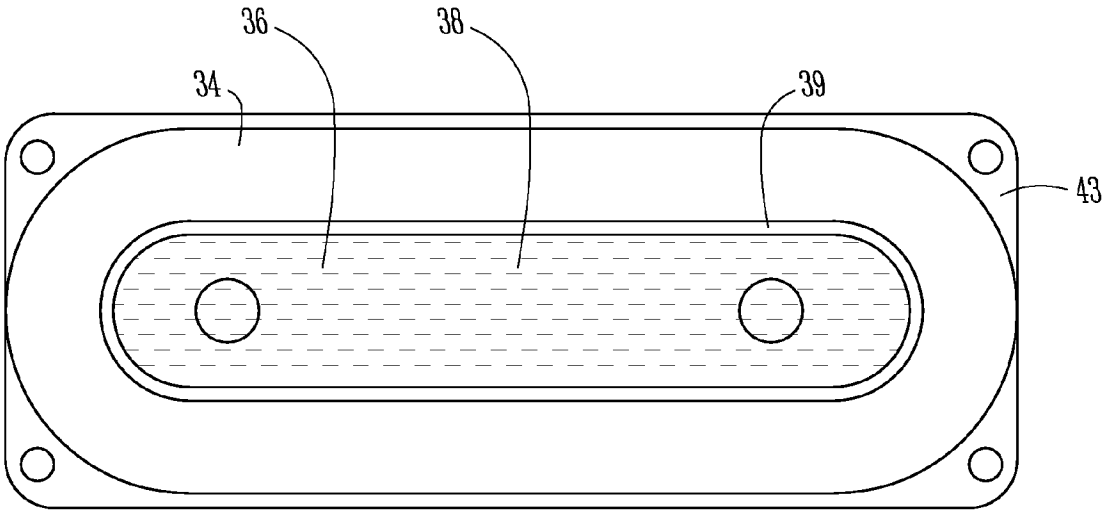
Figure 7F:
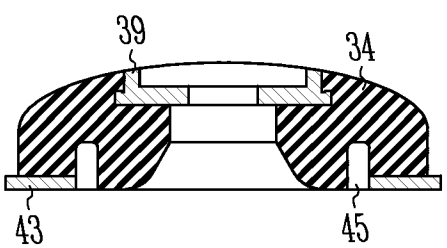
Figure 7D:
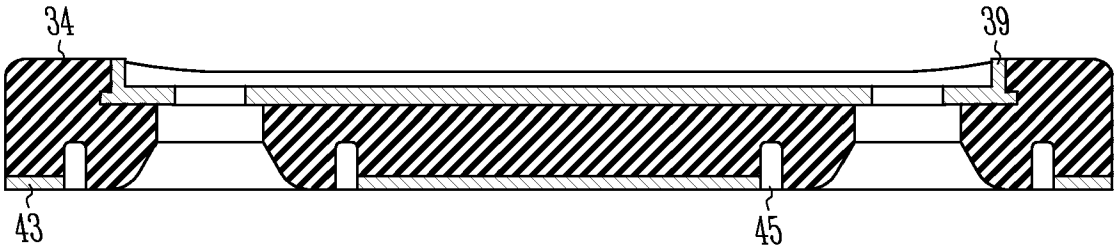
Figure 7H:
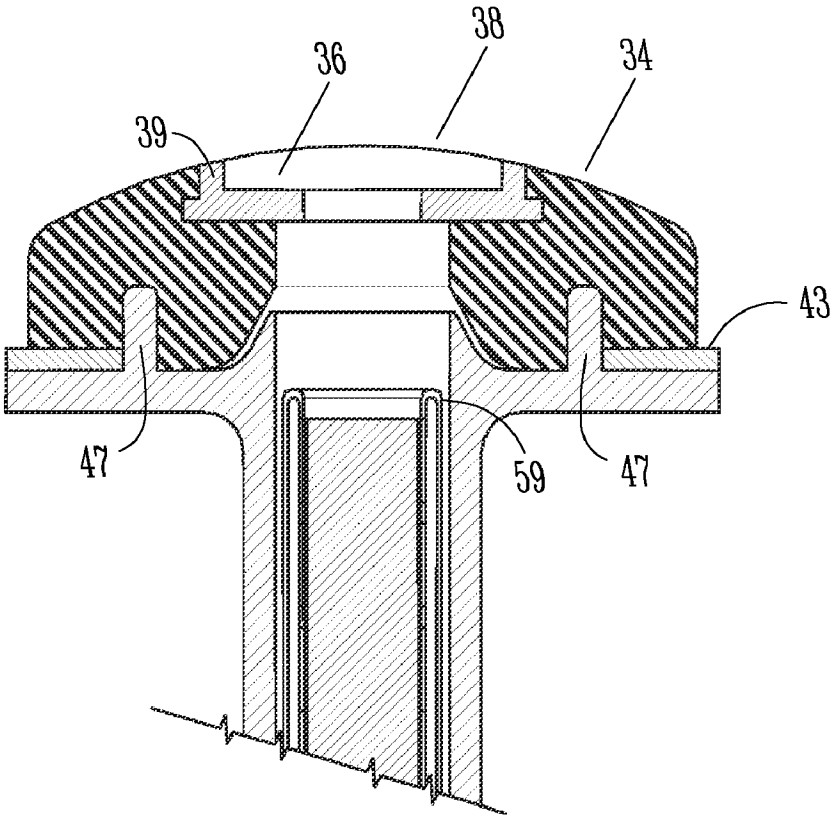
Figure 7G:
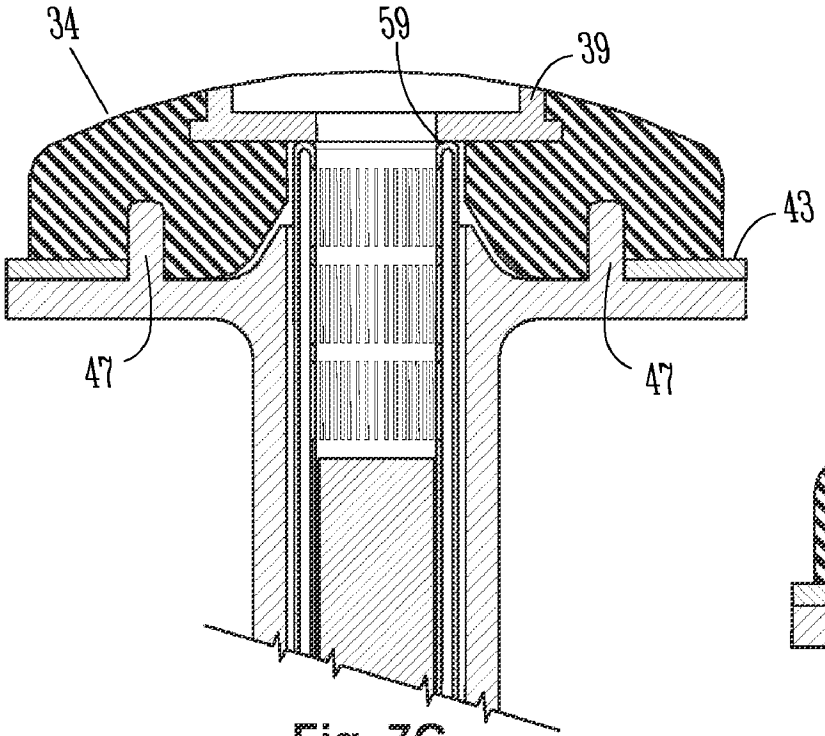

FIGS. 7A-F are CAD models and schematics of a sealing pad in accordance with this invention. FIG. 7A shows a 3D view of the elongated sealing pad. FIG. 7A shows rigid base 43 and elastomeric pad 34. Recess 36 fitted with steel aperture 39 is also shown. FIGS. 7B, 7C, and 7E show front, top, and side views of the structures shown in FIG. 7A. The width of the structure, as seen in FIG. 7E is 4.50" and the radius of the curvature is 4.12. FIGS. 7D and 7F show longitudinal and transverse cross-sectional views. In the embodiment shown in FIG. 7D, the length of recess 36 surrounded by steel aperture 39 is 9.00" and the length of elastomeric pad 34 is 11.45". In FIG. 7F, the width of recess 36 surrounded by aperture 39 is 1.75". It should be noted that all dimensions in the figures are approximate and may be varied in alternative embodiments.

In a preferred embodiment, the pad is provided with a metal cup-like structure that is molded to the rubber to facilitate sealing. Other geometries are possible but the basic principle is to support the rubber such that it seals against the borehole but is not allowed to be drawn into the flow area. A series of slots or an array of holes could also be used in alternative embodiments to press against the borehole and allow the fluid to enter the tool while still maintaining the basic elongated shape.

FIGS. 7G-H show additional detail about how the screen and gravel pack probe 32 works in a preferred embodiment of the present invention. As illustrated, in this embodiment the elongated sealing pad 34 is attached to a hydraulic ram and the probe with a slotted screen at one of the inlet openings. The alignment of sealing pad 34 with respect to probe 32 is ensured by sliding tongue 47 into groove 45 (shown in FIG. 7F.) Notice that the fluids are directed through the screen slots into an annular area, which connects to a flow line in the tool. When the hydraulic ram deploys the Oval Pad against the well bore, the elastomeric material of the pad is compressed. The hydraulic system continues to apply an additional force to the probe assembly, causing it to contact the steel opening aperture 39 of the elongated pad. Specifically, extendable probe assembly 59 shown in its retracted position in FIG. 7H pushes against steel aperture 39, as shown in FIG. 7G. Therefore, it will be appreciated that the steel aperture 39 is pressed against the borehole wall with greater force than the rubber. This system of deployment insures that the steel aperture 39 keeps the rubber from extruding and creates a more effective seal in a preferred embodiment. When the elongated pad 34 is retracted, the probe screen assembly is retracted and a wiper cylinder pushes mudcake or sand from the screen area. In alternative embodiments this screen can be replaced with a gravel pack type of material to improve the screening of very fine particles into the tool's flowline.

In another embodiment of the invention, the sealing pad design may be modified to provide isolation between different probes (such as 32*a* and 32*b* in FIG. 5A), which may be useful in certain test measurements. Thus, in pressure gradient tests, in which formation fluid is drawn into one probe and changes in pressure are detected at the other probe, isolation between probes is needed to ensure that there is no direct fluid flow channel outside the formation between the probe and the pressure sensor; the tested fluid has to flow though the formation.

Accordingly, such isolation between the probes 32*a* and 32*b* may be accomplished in accordance with the present invention by dividing slit 36 of the sealing pad, preferably in the middle, into two portions 36*a* and 36*b*. Slits 36*a* and 36*b* may also be covered with a slotted screen(s) 38 to filter out fines. As noted in the preceding section, isolation between the probes 32*a* and 32*b* may also be accomplished by providing probes 32*a* and 32*b* with separate elongated sealing pads 34*a* and 34*b* respectively. As before, each pad has a slit covered by a slotted screen to filter out fines. One skilled in the art should understand that in either of the above-described aspects of the invention the probe assembly has a large exposure volume sufficient for testing and sampling large elongated sections of the formation.

Various modifications of the basic pad design may be used in different embodiments of the invention without departing from its spirit. In particular, in designing a sealing pad, one concern is to make it long enough so as to increase the likelihood that multiple layers in a laminated formation may be covered simultaneously by the fluid channel provided by the slit in the pad. The width of the pad is likely to be determined by the desired angular coverage in a particular borehole size, by the possibility to retract the pad within the tester module as to reduce its exposure to borehole conditions, and others. In general, in the context of this invention an elongated sealing pad is one that has a fluid-communication recess that is longer in one dimension (usually along the axis of the borehole).

It should be noted that various embodiments of a sealing pad may be conceived in accordance with the principles of this invention. In particular, it is envisioned that a pad may have more than one slit, that slits along the face of the pad may be of different lengths, and provide different fluid communication channels to the associated probes of the device.

Finally, in one important aspect of the invention it is envisioned that sealing pads be made replaceable, so that pads that are worn or damaged can easily be replaced. In alternate embodiments discussed above, redundancy may be achieved by means of more than one sealing pad providing fluid communication with the inlets of the tester.

Operation of the Tool

With reference to the above discussion, formation-testing tool 10 of this invention may be operated in the following manner: in a wireline application, tool 10 is conveyed into the borehole by means of wireline 15 to a desired location ("depth"). The hydraulic system of the tool is deployed to extend rams 31*a* and 31*b* and sealing pad(s) including probes 32*a* and 32*b*, thereby creating a hydraulic seal between sealing pad 34 and the wellbore wall at the zone of interest. Once the sealing pad(s) and probes are set, a pretest is generally performed. To perform this pretest, a pretest pump may be used to draw a small sample of the formation fluid from the region sealed off by sealing pad 34 into flow line 15 of tool 10, while the fluid flow is monitored using pressure gauge 35*a* or 35*b*. As the fluid sample is drawn into the flow line 50, the pressure decreases due to the resistance of the formation to fluid flow. When the pretest stops, the pressure in the flow line 15 increases until it equalizes with the pressure in the formation. This is due to the formation gradually releasing the fluids into the probes 32*a* and 32*b*.

Formation's permeability and isotropy can be determined, for example, as described in U.S. Pat. No. 5,672,819, the content of which is incorporated herein by reference. For a successful performance of these tests isolation between two probes is preferred, therefore, configuration of probe module 30 shown in FIG. 6*b* or with a divided slit is desired. The tests may be performed in the following manner: Probes 32*a* and 32*b* are extended to form a hydraulically sealed contact between sealing pads 34*a* and 34*b*. Then, probe 32*b*, for example, is isolated from flow line 15 by a control valve. Piston pump 42, then, begins pumping formation fluid through probe 32*a*. Since piston pump 42 moves up and down, it generates a sinusoidal pressure wave in the contact zone between sealing pad 34*a* and the formation. Probe 32*b*, located a short distance from probe 32*a*, senses properties of the wave to produce a time domain pressure plot which is used to calculate the amplitude or phase of the wave. The tool then compares properties of the sensed wave with properties of the propagated wave to obtain values that can be used in the calculation of formation properties. For example, phase shift between the propagated and sensed wave or amplitude decay can be determined. These measurements can be related back to formation permeability and isotropy via known mathematical models.

It should be understood by one skilled in the art that probe module 30 enables improved permeability and isotropy estimation of reservoirs having heterogeneous matrices. Due to the large area of sealing pad 34, a correspondingly large area of the underground formation can be tested simultaneously, thereby providing an improved estimate of formation properties. For example, in laminated or turbidite reservoirs, in which a significant volume of oil or a highly permeable stratum is often trapped between two adjacent formation layers having very low permeabilities, elongated sealing pad 34 will likely cover several such layers. The pressure created by the pump, instead of concentrating at a single point in the vicinity of the fluid inlets, is distributed along slit 36, thereby enabling formation fluid testing and sampling in a large area of the formation hydraulically sealed by elongated sealing pad 34. Thus, even if there is a thin permeable stratum trapped between several low-permeability layers, such stratum will be detected and its fluids will be sampled. Similarly, in naturally fractured and vugular formations, formation fluid testing and sampling can be successfully accomplished over matrix heterogeneities. Such improved estimates of formation properties will result in more accurate prediction of hydrocarbon reservoir's producibility.

To collect the fluid samples in the condition in which such fluid is present in the formation, the area near sealing pad 34 is flushed or pumped. The pumping rate of the double acting piston pump 42 may be regulated such that the pressure in flow line 15 near sealing pad 34 is maintained above a particular pressure of the fluid sample. Thus, while piston pump 42 is running, the fluid-testing device 52 can measure fluid properties. Device 52 preferably provides information about the contents of the fluid and the presence of any gas bubbles in the fluid to the surface control unit 80. By monitoring the gas bubbles in the fluid, the flow in the flow line 15 can be constantly adjusted so as to maintain a single-phase fluid in the flow line 15. These fluid properties and other parameters, such as the pressure and temperature, can be used to monitor the fluid flow while the formation fluid is being pumped for sample collection. When it is determined that the formation fluid flowing through the flow line 15 is representative of the in situ conditions, the fluid is then collected in the fluid chamber 62.

When tool 10 is conveyed into the borehole, the borehole fluid enters the lower section of fluid chamber 62*b*. This causes piston 64 to move inward, filling bottom chamber 62*b* with the borehole fluid. This is because the hydrostatic pressure in the conduit connecting bottom chamber 62*b* and a borehole is greater than the pressure in the flow line 15. Alternatively, the conduit can be closed and by an electrically controlled valve and bottom chamber 62*b* can be allowed to be filled with the borehole fluid after tool 10 has been positioned in the borehole. To collect the formation fluid in chamber 62, the valve connecting bottom chamber 62*a* and flow line 15 is opened and piston pump 42 is operated to pump the formation fluid into flow line 15 through the inlets in slit 36 of sealing pad 34. As piston pump 42 continues to operate, the flow line pressure continues to rise. When the flow line pressure exceeds the hydrostatic pressure (pressure in bottom chamber 62*b*), the formation fluid starts to fill in top chamber 62*a*. When the upper chamber 62*a* has been filled to a desired level, the valves connecting the chamber with both flow line 15 and the borehole are closed, which ensures that the pressure in chamber 62 remains at the pressure at which the fluid was collected therein.

The above-disclosed system for the estimation of relative permeability has significant advantages over known permeability estimation techniques. In particular, borehole formation-testing tool 10 combines both the pressure-testing capabilities of the known probe-type tool designs and large exposure volume of straddle packers. First, tool 10 is capable of testing, retrieval and sampling of large sections of a formation along the axis of the borehole, thereby improving, inter alia, permeability estimates in formations having heterogeneous matrices such as laminated, vugular and fractured reservoirs.

Second, due to the tool's ability to test large sections of the formation at a time, the testing cycle time is much more efficient than the prior art tools. Third, it is capable of formation testing in any typical size borehole.

In an important aspect of the invention, the use of the elongated sealing pad of this invention for probing laminated or fracture reservoir conditions may be optimized by first identifying the prospective laminated zones with conventional, high-resolution wireline logs. In a preferred embodiment, the identification of such zones may be made using imaging tools, such as electric (EMI) or sonic (CAST-V) devices, conventional dipmeter tools, microlog tools, or micro-spherically focussed logs (MSFL). As an alternative, prospective layered zones can be identified using high-resolution resistivity logs (HRI or HRAI), or nuclear logs with high resolution (EVR). Other tools or methods for identifying thin-bed laminated structures will be apparent to those of skill in the art and are not discussed in further detail.

In a first embodiment, the identification of the laminate structure best suitable for testing, using the device and methods of this invention, is done by running the identifying logging tool first and then rapidly positioning the probes of the fluid tester in a sealing engagement with a surface of the borehole located by the logging tool. In the alternative, the fluid tester may be used in the same run as the logging device, to use the rapid-deployment ability of the Oval Pad design of the invention.

Advantages of the Proposed Approach

Some of the primary advantages to the novel design approach using elongated pads are as follows:

1. enables placement of an isolated flow path across an extended formation face along the borehole trajectory;

2. provides the ability to expose a larger portion of the formation face to pressure measurements and sample extraction;

3. potential benefits in laminated sequences of sand/silt/shale, where point-source probe measurements may not connect with permeable reservoir porosity;

4. potential benefit in formations subject to localized inconsistencies such as intergranular cementation (natural or induced), vugular porosity (carbonates and volcanics) and sectors encountering lost circulation materials;

5. ability to employ variable screen sizes and resin/gravel selectivity;

6. stacked for multiple redundancy or variable configuration of multiple probe section deployments, including standard and gravel pack probes;

7. reduced risk of sticking as may be encountered with packer type pump tester devices;

8. faster cleanup and sample pumpout times under larger differential pressures;

9. easily adapted to existing wireline, LWD or DST technologies;

10. quicker setting, testing and retracting times over straddle packers;

11. ability to take multiple pressure tests and samples in a single trip.

Persons skilled in the art will recognize other potential advantages, including better seating and isolation of the pad versus straddle packers, ability to perform conventional probe type testing procedures, and others.

APPLICATIONS AND COMPARISON EXAMPLES

As noted above, the tester devices and methods in accordance with the present invention are suitable for use in a wide range of practical applications. It will be noted, however, that the advantages of the novel design are most likely to be apparent in the context of unconventional reservoirs, with a particular interest in laminated reservoirs. Thus, reservoir types, the exploration of which is likely to benefit from the use of the systems and methods of this invention, include, without limitation, turbidites and deepwater sands, vugular formations, and naturally fractured reservoirs, in which the approach used in this invention will allow for sampling (pressure and fluid) of a larger section of the formation along the axis of the tool and borehole.

Importantly, in accordance with a preferred embodiment of the invention, MWD testing would benefit from the use of the device in accordance with this invention, for both pressure testing (i.e., formation pressure and mobility) as well as sampling. It is known that a probe device must flow at less than 0.1 cc/sec, which means the pump is close to 4000 psi pressure differential. It is difficult to devise a flow control system to control a rate below 0.1 cc/sec, and even if this were possible there would still be a considerable error in the mobility measurement.

The table below summarizes finite element simulations of a test design using the novel elongated pad ("Oval Pad") approach of this invention used with the Reservoir Description Tool ("RDT") by Halliburton, as compared with a simulation of a prior art tool using inflatable straddle packers (the "Inflatable Packers" design). The prior art simulations illustrated here are for the Modular Formation Dynamics Tester ("MDT") by Schlumberger.

The two tester configurations are compared in FIGS. 8A and 8B, where the Oval Pad of this invention (RTD Straddle Pad) is represented in FIG. 8A as a slot area 1.75" wide and 9.0" long, while the Inflatable Packers flow area of the prior art (MDT Inflatable Straddle Packers) is modeled as a cylinder 8.5" in diameter and 39" long, as shown in FIG. 8B. The 9" oval pad was selected for comparison against the 39" straddle packer as 9" is a preferred dimension in a specific embodiment, and the 39" straddle packer represents typical prior technology.

It will be noticed that while the prior art Inflatable Packers design has a full 360° (26.7") coverage, the Oval Pad design, in accordance with this invention, has an equivalent of only 26.7° (1.75") coverage angle. Two flow rates are predicted for each configuration, as illustrated in FIG. 9. The first flow rate is determined at a fixed 100 psi pressure pumping differential. The second flow rate is the maximum flow rate for each system, which considers the respective pump curves and a 1000 psi hydrostatic overbalance. As illustrated in the figure, the formation pumpout rate varies linearly and the maximum flow rate is determined by calculating the intersection of the formation rate curve with the pump curve, which is also nearly linear.

The first set of simulations consider a low permeability zone (1 mDarcy) with a single 1" wide high-permeability lamination (1 Darcy) intersecting the vertical spacing. The same formation model is exposed to the Oval Pad design of this invention and the prior art Inflatable Packers flow area. As illustrated in FIGS. 10 and 11, the Oval Pad produces at 10.2 cc/sec and the Inflatable Packers design produces 26.9 cc/sec with a 100 psi pressure differential.

The maximum pumping rate of 38.8 cc/sec is determined for the Oval Pad design of this invention, assuming a conservative pump curve for the flow control pump-out section (FPS) of the tool and an overbalance of 1000 psi. The maximum pumping rate for the prior art straddle packer design is estimated at 29.1 cc/sec, which estimate is determined using a high-end pump curve estimate for the MDT tool. It is notable that despite the increased vertical spacing and exposed area of the straddle packer's design, its maximum flow rate is lower for the laminated zone case. This result is likely due to the MDT reduced pumping rate capabilities as compared to the pump-out module of the RDT tool.

| Simulation | Vertical Spacing (inches) | Packer Equivalent Angle | Radial Equivalent Width (inches) | Lamination 1 Darcy 1" Thick | Flow Rate (cc/sec) @ 100 psi differential | Maximum Rate (cc/sec) @ 1000 psi overbalance |
|---|---|---|---|---|---|---|
| RDT Oval Pad | 9.00 | 23.6° | 1.75 | Yes | 10.2 | 38.8 * |
| MDT Inflatable Packers | 39.00 | 360.0° | 26.7 | Yes | 26.9 | 29.1 † |
| RDT Oval Pad | 9.00 | 23.6° | 1.75 | No | 0.16 | 3.8 * |

-continued

| Simulation | Vertical Spacing (inches) | Packer Equivalent Angle | Radial Equivalent Width (inches) | Lamination 1 Darcy 1" Thick | Flow Rate (cc/sec) @ 100 psi differential | Maximum Rate (cc/sec) @ 1000 psi overbalance |
|---|---|---|---|---|---|---|
| MDT Inflatable Packers | 39.00 | 360.0° | 26.7 | No | 2.1 | 19.5 † |

Figure 1A:
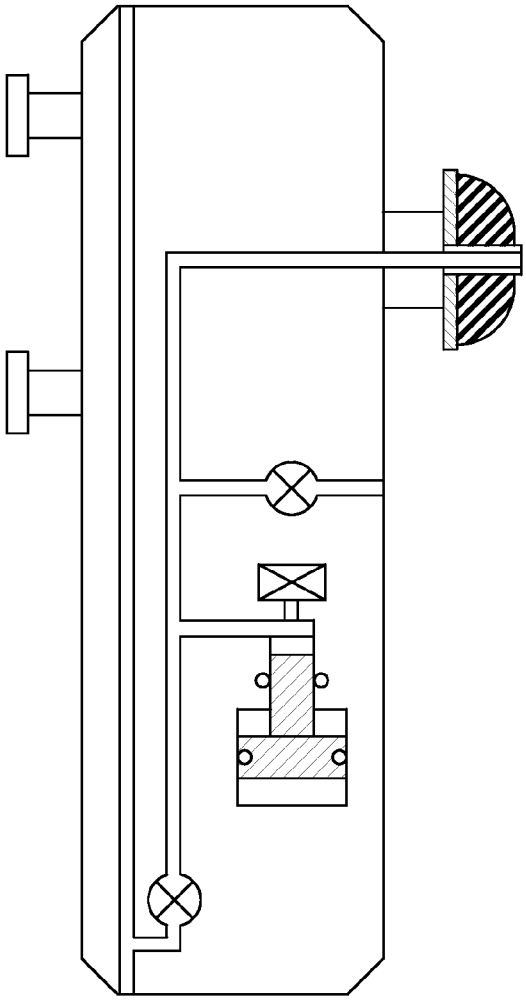
Fig. 1A (Prior Art)
FIG. 1 shows a typical prior art wireline formation tester with a cup-shaped sealing pad providing point contact with the formation.
Figure 1B:
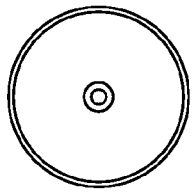
Fig. 1B (Prior Art)
Figure 2:
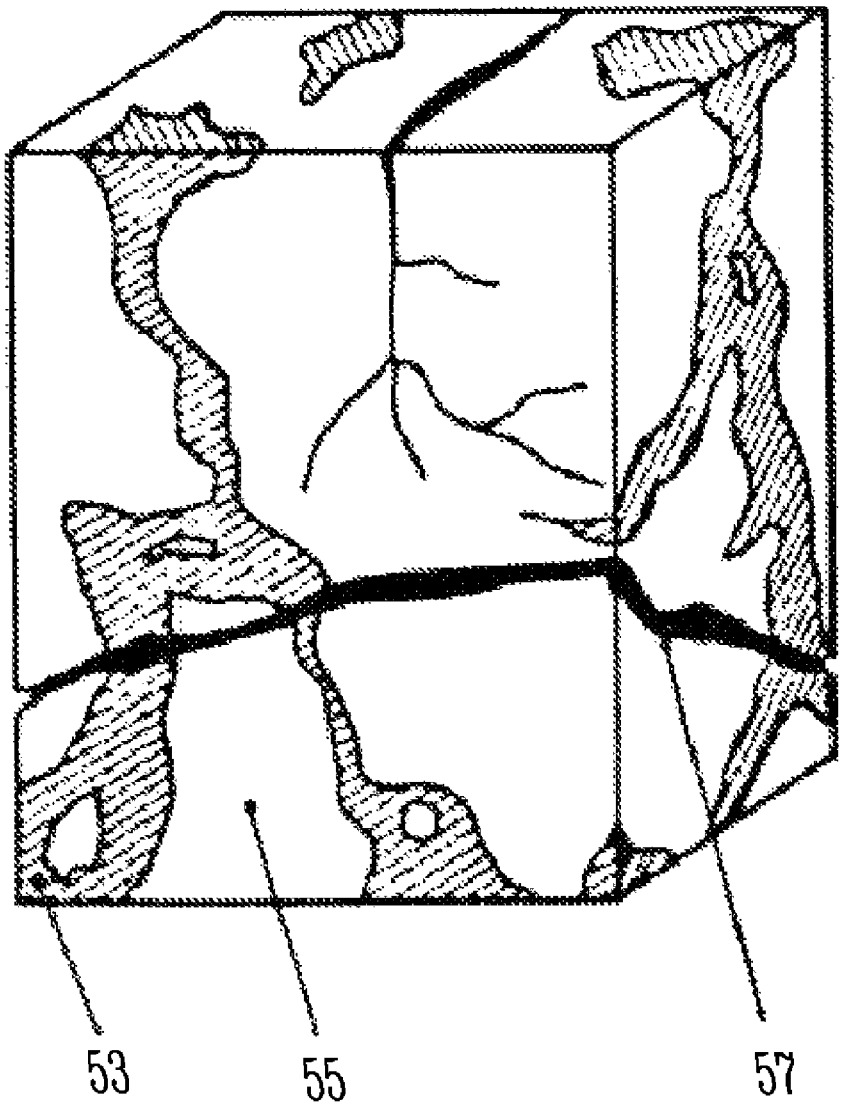
FIG. 2 is a graphic illustration of a sample of laminated, fractured and vugular formation, frequently encountered in practical applications.
Figure 3:
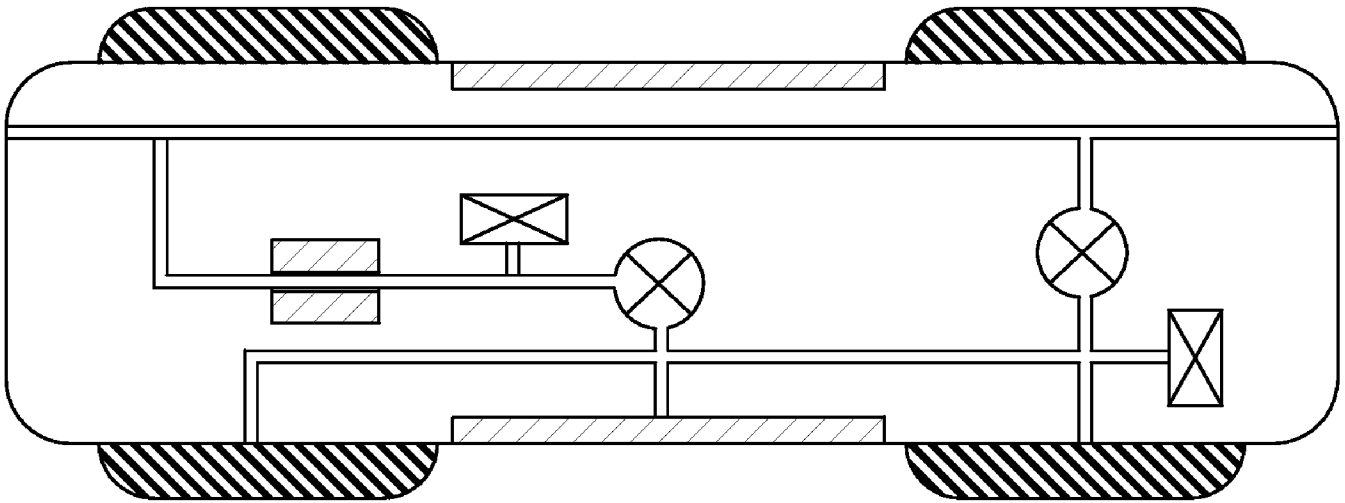
Fig. 3 (Prior Art)
FIG. 3 is an illustration of a prior art tool using inflatable straddle packers to stabilize the flow rate into the tool.

* RDT Pumpout Rate using 3600 psi @ 0 cc/sec and 0 psi @ 63 cc/sec pump curve (see FIG. 2)
† MDT Pumpout Rate using 3600 psi @ 0 cc/sec and 0 psi @ 42 cc/sec pump curve (see FIG. 2)

FIG. 10 is a pressure contour plot of Oval Pad ¼ cross section. This finite element simulation shows how the Oval Pad pressures are distributed in the formation at 10.2 cc/sec producing a 100 psi pressure drop from formation pressure. The formation has a 1" lamination located at the center of the pad.

FIG. 11 is a pressure contour plot of a straddle packer using an axisymmetric finite element simulation. A 100 psi pressure drop between the straddle packers creates a 26.9 cc/sec flow rate. The formation has a 1" lamination centered between the straddle packers.

The other case illustrated for comparison is a testing of low permeability zones. In particular, the simulations were performed with a homogeneous 1 mDarcy zone. In this case, as illustrated in FIG. 12, a 100 psi pressure drop causes the Oval Pad to flow at 0.16 cc/sec. The same pressure drop with Inflatable Packers produces 2.1 cc/sec, as illustrated in FIG. 13. While the difference appears relatively large, it should be considered in the context of the total system pumping capabilities. Thus, because of the RDT increased pumping capacity, a maximum pumping of 3.8 cc/sec is determined for the RDT versus 19.5 cc/sec for the MDT, reducing any advantage straddle packers may have in low permeability zones.

Notably, the increased rate for the Inflatable Packers design is less important if one is to consider the time to inflate the packers and void most of the contaminating fluid between them. Additionally, it is important to consider that the Oval Pad design of this invention should more easily support higher pressure differentials than with the Inflatable Packers, as is the case with probes.

The plots in FIGS. 14 and 15 show how the pumping rate and pumping time compare over a wide range of mobilities, if the pumping system stays the same. It will be seen that the Inflatable Packer's design generally enables sampling to occur at a faster rate than the Oval Pad or probe devices. FIG. 15 is an estimate of the pumping time required, assuming the total volume pumped in order to obtain a clean sample is the same for each system (i.e., 20 liters). If only the sampling time is considered after the Inflatable Packers are deployed it would appear that using straddle packers allows faster sampling. However, if the inflation and volume trapped between the packers is considered, as expected, the Oval Pad would obtain a clean sample faster than the Inflatable Packers over a large range of mobilities. It is notable that the Inflatable Packers design is advantageous only in very low permeable zones. However, it can be demonstrated that if the Oval Pad design is used in a zone that has natural fractures or laminations it would still sample considerably faster than the prior art Inflatable Packers design.

Yet another important consideration in comparing the Oval Pad to the Inflatable Packers designs in practical applications is pressure stabilization. Because of the large volume of fluid filling the inflatable packers and the space between the packers, the storage volume is many orders of magnitude larger compared with the Oval Pad design of this invention. This consideration is an important benefit of the use of the design of this invention in transient pressure analysis or simply for purposes of obtaining a stable pressure reading.

In reviewing the preceding simulations it is important to note that they only illustrate the case of using a single elongated pad. It will be apparent that the use of additional sealing pads will significantly enhance the comparative advantages of fluid tester designs using the principles of this invention.

The foregoing description of the preferred embodiments of the present invention has been presented for purposes of illustration and explanation. It is not intended to be exhaustive nor to limit the invention to the specifically disclosed embodiments. The embodiments herein were chosen and described in order to explain the principles of the invention and its practical applications, thereby enabling others skilled in the art to understand and practice the invention. But many modifications and variations will be apparent to those skilled in the art, and are intended to fall within the scope of the invention, defined by the accompanying claims.

What is claimed is:

1. An apparatus for use with a formation tester to support an elongated sealing pad having an elongated recess and a rigid plate installed in the elongated recess, the rigid plate having an edge embedded into the elongated sealing pad and a flange some distance away from the edge, the apparatus comprising:

a rigid base for attaching to the elongated sealing pad, wherein the rigid base has an opening into the elongated recess of the elongated sealing pad;

one or more extendable supports attached to the rigid base, operable to protrude the rigid base away from the tester; and an extendable probe assembly operable to move into contact with the rigid plate.

2. The apparatus of claim 1 wherein the elongated sealing pad is attached to the rigid base.

3. The apparatus of claim 2, wherein the rigid base is molded to the elongated sealing pad.

4. The apparatus of claim 2, wherein the elongated sealing pad is removably attached to the rigid base.

5. The apparatus of claim 1, further comprising a fluid path establishing fluid communication from the opening in the rigid base into the interior of the tester.

6. The apparatus of claim 5, wherein the fluid path establishes fluid communication through the one or more extendable supports.

7. The apparatus of claim 1, further comprising at least one high-resolution temperature compensated gauge pressure transducer.

8. The apparatus of claim 1, wherein the opening of the rigid base is connected to a pretest pump within the tester by a flow line.

9. The apparatus of claim 1, wherein the one or more extendable supports comprises a hydraulic piston.

10. The apparatus of claim 1, wherein the one or more extendable supports comprises a hydraulic ram.

11. The apparatus of claim 10, wherein the apparatus comprises two extendable supports and each of the two extendable supports establishes a separate fluid path to the interior of the tester.

12. The apparatus of claim 1, wherein the one or more extendable supports are operable to exert pressure on the rigid base and the extendable probe assembly is operable to exert pressure on the rigid plate.

13. The apparatus of claim 1, wherein the rigid plate has one or more openings.

14. The apparatus of claim 13, wherein the flange protrudes away from the rigid base.

15. The apparatus of claim 1, wherein the elongated sealing pad has a groove and the extendable support has a tongue configured for insertion into the groove of the sealing pad.

* * * * *